US007737932B2

(12) United States Patent
Kato

(10) Patent No.: US 7,737,932 B2
(45) Date of Patent: Jun. 15, 2010

(54) DRIVE CIRCUIT FOR DISPLAY DEVICE

(75) Inventor: Hisanao Kato, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 1033 days.

(21) Appl. No.: 11/018,472

(22) Filed: Dec. 22, 2004

(65) Prior Publication Data

US 2005/0156842 A1 Jul. 21, 2005

(30) Foreign Application Priority Data

Dec. 25, 2003 (JP) ..... 2003-429640

(51) Int. Cl.
*G09G 3/36* (2006.01)
*G09G 5/10* (2006.01)

(52) U.S. Cl. ..... 345/89; 345/690

(58) Field of Classification Search ..... 345/87–100, 345/690–699

See application file for complete search history.

(56) References Cited

U.S. PATENT DOCUMENTS 5,245,328 A * 9/1993 Garrett ..... 345/696
5,796,379 A * 8/1998 Enomoto et al. ..... 345/89
6,014,122 A * 1/2000 Hashimoto ..... 345/98
2001/0015712 A1* 8/2001 Hashimoto ..... 345/92
2002/0039090 A1* 4/2002 Saito et al. ..... 345/89

FOREIGN PATENT DOCUMENTS

JP 2002-108301 4/2002
JP 2004-271930 9/2004

* cited by examiner

*Primary Examiner*—Alexander Eisen
*Assistant Examiner*—Cory A Almeida
(74) *Attorney, Agent, or Firm*—McGinn IP Law Group, PLLC

(57) ABSTRACT

A drive circuit for driving a display device includes: a first data latch circuit that holds image data corresponding to one line from; a second data latch circuit that holds image data held in the first data latch circuit; a decoding circuit that decodes the image data held in the second data latch circuit; a gradation amplifier circuit that includes gradation amplifiers that amplify or buffer, and output respective gradation voltages; a gradation voltage selection circuit that selects gradation voltages necessary for display; a decision circuit that decides on use/non-use of gradations, using the image data; and an enabling/disabling circuit that selectively disables operation of the gradation amplifiers corresponding to gradations that are identified as not to be used, using the decision results output from the decision circuit.

15 Claims, 14 Drawing Sheets

RELATED ART

RELATED ART

RELATED ART

RELATED ART

DRIVE CIRCUIT FOR DISPLAY DEVICE

BACKGROUND OF THE INVENTION

1. Field of the Invention

The present invention relates to a drive circuit for a display device (for example liquid-crystal display device) and in more detail relates to a drive device for a display device whereby miniaturization and reduction of current consumption can be achieved.

2. Description of the Related Art

A drive circuit for a liquid-crystal display device incorporating RAM (Random Access Memory) as a frame memory is commonly employed in liquid-crystal models for mobile telephones. For the drive circuits employed in such applications, miniaturization, reduced current consumption and improved image quality are demanded. It is therefore desired to achieve miniaturization of the liquid-crystal display device as a whole by miniaturizing the drive circuit, to achieve reduction of current consumption by eliminating surplus operations and to achieve improvement in image quality by improving performance.

Typically, the drive circuit for a liquid-crystal display device outputs a plurality of gradation voltages (for example, in the case of 64 gradations, 64 gradation voltages) from a prescribed number of output terminals (for example, in the case where there are three output terminals for R, G and B at each pixel, with a total pixel number=132, the total number of output terminals is 396). In this way, the desired color image is displayed by varying the amount of light transmitted through the liquid-crystal panel for each pixel.

The drive circuit for a liquid-crystal display device includes a gradation voltages output circuit that select a single desired gradation voltage using gradation data from a prescribed number of gradation voltages (in the image data) and output these selected gradation voltages to the various output terminals. It is therefore necessary for the gradation voltages output circuit to amplify (or buffer) the gradation voltages. Two methods of arranging the amplifiers for performing this are conventionally known, namely, "switch drive and "amplifier drive". "Switch drive" means that the same number of gradation amplifiers as the number of voltage gradations (for example, 64 gradation amplifiers if the number of voltage gradations is 64) is provided for each of the gradations, and a gradation voltage selection circuit that is provided at the output of these gradation amplifiers selects and outputs the desired gradation voltage to each output terminal. The characteristic feature of this method is that the current consumption for output of the gradation voltage is that consumed within the gradation amplifiers, which are provided in the same number (for example 64) as the number of voltage gradations.

In contrast, "amplifier drive" means that respective amplifiers are arranged at all of the plurality of output terminals (for example all of 396 output terminals), and the gradation voltage at each output terminal is amplified (or buffered). In the case of this method, the current consumption for output of the gradation voltage is that consumed within the amplifiers, which are of the same number as the number of output terminals (for example 396).

Thus, comparing the two methods: "switch drive" and "amplifier drive" in respect of their current consumption, they differ in that, in the case of "switch drive", current is consumed in centralized fashion by gradation amplifiers of the same number (for example 64) as the number of voltage gradations, whereas, in the case of "amplifier drive", current is consumed in dispersed fashion by the same number of amplifiers as the number of output terminals (for example 396), which is considerably greater than the number of voltage gradations.

In the case of a data line drive circuit i.e. a circuit in which a plurality of data lines of a liquid-crystal panel are driven by simultaneously outputting a plurality of different gradation voltages from a plurality of output terminals, if "switch drive" is adopted, usually, the same number of gradation amplifiers as the number of gradations are provided. Also, typically, a plurality of different gradation voltages amplified (or buffered) by these gradation amplifiers are selected by the gradation voltage selection circuit and respectively supplied to the output terminals of the data line drive circuits. A technique for reducing current consumption in this case is to identify the gradation amplifiers that are employed and the gradation amplifiers that are not employed when the gradation voltages are outputted, and to disable the operation of the gradation amplifiers that are not employed. An example of this technique is disclosed in Japanese Unexamined Patent Application Publication No. 2002-108301.

FIG. 11 is a functional block diagram showing an example of a data line drive circuit corresponding to the circuit layout disclosed in Japanese Unexamined Patent Application Publication No. 2002-108301, in which no frame memory RAM is incorporated.

The data line drive circuit of FIG. 11 comprises a decision circuit 101, an enabling/disabling circuit 102, a gradation voltage generating circuit 103, a gradation amplifier circuit 104, a first data latch circuit 105, a second data latch circuit 106, a level shifting/decoding circuit 107, a gradation voltage selection circuit 108, and an output circuit 109. n output terminals S1 to Sn corresponding to then output lines are provided on the output side of the output circuit 109 (n is an integer of 2 or more).

The decision circuit 101 decides on the gradation to be used (i.e. the respective gradations of the n output lines corresponding to the input gradation data) on the n output lines in accordance with 6-bit digital gradation data that is input (on an interface) from an external CPU (central processing unit, not shown) and outputs the result of this decision in 64-bit form. The enabling/disabling circuit 102 determines whether the respective gradation is to be used or not in accordance with the 64-bit decision results data from the decision circuit 101 and delivers a 64-bit control signal in accordance with this result to the gradation amplifier circuit 104. On the other hand, the gradation voltage generating circuit 103 generates the same number of gradation voltages as the prescribed number of gradations (in this case, 64) and delivers these to the gradation amplifier circuit 104.

The gradation amplifier circuit 104 comprises 64 gradation amplifiers, of the same number as the number of gradations, and respectively amplifies (or buffers) the 64 different gradation voltages delivered from the gradation voltage generating circuit 103. The operation of these gradation amplifiers is controlled in accordance with a control signal delivered from the enabling/disabling circuit 102 and selectively disables the operation of gradation amplifiers corresponding to gradations that are determined not to be used. This enables current consumption to be reduced. The gradation amplifier circuit 104 outputs to the gradation voltage selection circuit 108 a analogue gradation voltage that is thus subjected to control as to whether the amplifier in question is to be used or not and which is amplified (or buffered).

The first data latch circuit 105 successively stores the 6-bit gradation data input from outside, in accordance with a latch signal LAT. The second data latch circuit 106 receives the gradation data of the n output lines stored in the first data latch circuit 105, in accordance with a horizontal signal STB, and holds the gradation data to output simultaneously onto the n output lines. For each of the n output lines, the level shifting/decoding circuit 107 performs level shift the 6-bit gradation data delivered from the second data latch circuit 106 and identifies the gradation that is to be selected by decoding thereof.

The gradation voltage selection circuit 108 inputs 64 analogue gradation voltages whose use or non-use is controlled, and which are amplified (or buffered) by 64 gradation amplifiers in the gradation amplifier circuit 104. For each of the n output lines, the gradation voltage selection circuit 108 selects a single analogue gradation voltage level from these 64 different analogue gradation voltage levels, in accordance with the identification result obtained from the level shifting+ decoding circuit 107. The output circuit 109 respectively outputs the gradation voltage which is thus selected to the n output terminals S1 to Sn through the n output lines.

In the prior art data line drive circuit layout shown in FIG. 11, the power consumption can be reduced, but problems occur when RAM (Random Access Memory) that functions as a frame memory is added.

In a liquid-crystal display device, which is employed in appliances where a still image is often displayed, such as a mobile telephone, a frame memory is incorporated in the data line drive circuit. Reduction in power consumption is aimed at by arranging for the signal from the CPU to transfer image data only when the frame image is changed. The various signals delivered from the CPU and the various types of control signal of the data line drive circuit are therefore asynchronous. However, in order to display an image, the data line drive circuit must be driven with a fixed period. Also, when image data corresponding to one line are transferred from the frame memory to the first data latch circuit 105 that functions as a line memory, the image data corresponding to one line are transferred simultaneously using a latch signal of fixed period. Consequently, it is necessary to decide upon use/non-use of gradations in the image data in the line memory simultaneously.

Considering the case where the data line drive circuit FIG. 11 incorporates RAM that functions as a frame memory, this RAM must be arranged upstream of the first data latch circuit 105. Consequently, gradation data corresponding to one frame in the image data delivered from the CPU is first of all stored by being successively inputted to this RAM with a given timing. After this, data corresponding to one line of the gradation data is simultaneously transferred, with another timing, from this RAM to the first data latch circuit 105, where it is stored. Consequently, the problem arises that, even if the respective gradations to be used for the n output lines have been decided upon using the gradation data inputted to this RAM in the same way as was done in the case of the circuit layout shown in FIG. 11, the decision results do not necessarily agree with the gradations to be used by the gradation data outputted from this RAM (gradation data that was transferred and stored by the first data latch circuit 105).

Also, since the image to be displayed by the image unit is unchanged, when the image is displayed by using the gradation data corresponding to one line stored in this RAM, there is no actual input action to input gradation data itself to this RAM. Consequently, in the prior art construction, the problem arises that image display cannot be achieved unless a decision of use/non-use is made based on input of gradation data from outside.

Thus, with the prior art data line drive circuit shown in FIG. 11, it is not possible to cope with requirements for RAM incorporation as described above. An example of a technique for effecting improvement in this respect is disclosed in Japanese Unexamined Patent Application Publication No. 2004-271930 "Drive circuit for a display device" (applied for on the 10 Mar. 2003). FIG. 12 shows an example of the circuit layout of the data line drive circuit used in the drive circuit of the display device of Japanese Unexamined Patent Application Publication No. 2004-271930.

As shown in FIG. 12, this data line drive circuit has the same construction as the data line drive circuit of FIG. 11 except for the fact that RAM 110 that functions as a frame memory (used for storing the image data corresponding to a single frame) is inserted upstream of the first data latch circuit 105 and the fact that use/non-use of the each gradation is decided upon using 64-bit gradation voltage data decision circuit 101 from the gradation voltage selection circuit 108. Accordingly, in order to simplify the description, identical circuit elements are given the same reference symbols as in FIG. 11 and description relating thereto is omitted.

The RAM 110 stores an amount of 6-bit gradation data inputted from outside corresponding to one frame. The amount of gradation data corresponding to one line (corresponding to n output lines) of the amount of data corresponding to one frame that is stored in the RAM 110 is simultaneously transferred to the first latch circuit 105 in response to a latch signal LAT. This amount of gradation data corresponding to one line is held in the first latch circuit 105. Also, the gradation data corresponding to one line (corresponding to n output lines) that is held in the first data latch circuit 105 is transferred simultaneously to the second data latch circuit 106 in response to the horizontal signal STB and is held in the second data latch circuit 106. The holding of this gradation data by the second data latch circuit 106 is continued for a horizontal period (1 H).

It should be noted that the first data latch circuit 105 is provided for the purpose of arranging that in the case where a gradation data write signal to the RAM 110 delivered from the CPU and a latch signal LAT are delivered overlapping in time, writing to the RAM 110 is performed with priority.

The decision circuit 101 examines the 6-bit gradation data corresponding to one line in the gradation voltage selection circuit 108 and decides on gradations which are then selected (gradations to be used) and gradations that are not selected (gradations not to be used). This utilizes the fact that this gradation use/non-use decision function and the original gradation voltage selection function possessed by the gradation voltage selection circuit 108 have in common the decoding of the same 6-bit data to 64-bit data. The circuit layout shown in FIG. 13A to FIG. 13D is employed for realizing this gradation use/non-use decision function.

FIG. 13A to FIG. 13D are views showing an example of a circuit, specifically decision circuit 101, that decides upon use/non-use (selection/non-selection) of gradations, corresponding to a single display line (corresponding to n output lines). The circuit layout is the same for each of the n output lines, so in FIG. 13A to FIG. 13D only the portion relating to a single output terminal S1 is shown.

In the decision circuit 101 of the construction shown in FIG. 13A to FIG. 13D, in the gradation voltage selection circuit 108 having a typical construction, switches 205 for selecting the gradation to be used in accordance with the output of the level shifting/decoding circuit 107 are provided. Also, in order to make possible the decision of a selection/non-selection of the gradation, switches 202 are provided that control the connection/non-connection action with the output terminal S1 respectively on the output sides of the 64 gradation amplifiers 201. These gradation amplifiers 201 are of the same number as the number of gradations (these gradation amplifiers 201 are provided in the gradation amplifier circuit 104). The decision circuit 101 of FIG. 13A to FIG. 13D is further provided with: switches 203*a* for pre-charging the power source voltage VDD on the Vn line (output side line of the switches 202); switches 207*a* for dropping the potential of the Vn line from the power source potential VDD to the earth level GND; and switches 206 for preventing the decision action of use/non-use (selection/non-selection) of a gradation being influenced by the output terminals S1 to Sn.

The decision circuit 101 of the construction shown in FIG. 13A to FIG. 13D reads and decodes an amount corresponding to one line of gradation data in the RAM 110 in the condition of FIG. 13A and performs opening/closing control of the gradation selection switches 205 in accordance with the result thereof. If a gradation voltage amplified (buffered) by the gradation amplifier 201 of FIG. 13A is selected, the gradation selection switch 205 thereof is turned ON (closed); if the gradation voltage is not selected, the gradation selection switch 205 is turned OFF (opened). This is the normal action based on the gradation voltage selection function of the gradation voltage selection circuit 108.

When the 6-bit gradation data delivered from the RAM 110 is decoded to 64-bit gradation data, in other words when the horizontal signal STB becomes high level (H), as shown in FIG. 13B, the power source voltage pre-charging switch 203*a* is turned ON. In this way, the power source voltage VDD is pre-charged onto the line Vn (output side of the switch 202) and, as a result, the line Vn becomes VDD level.

Next, after the power source voltage pre-charging switch 203*a* has returned to OFF, the ground voltage application switch 207*a* is turned ON. If, at this time, the gradation selection switch 205 is turned ON (if the gradation in question is selected), as shown in FIG. 13C, the line Vn drops from the VDD level to the GND level. Conversely, if at this point the gradation selection switch 205 is turned OFF (the gradation in question is not selected), as shown in FIG. 13D, the line Vn is held at the VDD level.

Thus, if the corresponding gradation is selected, the Vn line (the output side of the gradation amplifier 201 and gradation selection/non-selection decision switch 202 i.e. the output end of the gradation amplifier circuit 104) becomes GND level and if the corresponding gradation is not selected, the Vn line becomes VDD level. It is thereby possible for the decision circuit 101 to decide on selection/non-selection of the each gradation at this time, by reading the voltage level of the n Vn lines in the gradation voltage selection circuit 108.

The enabling/disabling circuit 102 disables the operation of the unselected gradation amplifier 201 in accordance with the result of the decision by the decision circuit 101 which has thus been obtained. After this, when the gradation selection/non-selection decision switch 202 and the decision operation effect-preventing switch 206 are turned ON, the output of the 64 gradation amplifiers 201 is delivered to the output terminals S1 to Sn.

FIG. 14 is a timing chart showing the operation of the drive circuit FIG. 12. The operation of the decision circuit 101 constructed as shown in FIG. 13 may be described as follows with reference to this timing chart. In order to simplify the display, in FIG. 14, only the waveform related to the output terminal S1 is shown. Also, in FIG. 14, "1 H" indicates one horizontal synchronization period.

First of all, at the timing 1 in FIG. 14, the latch signal LAT is turned ON, and, in response thereto, the gradation data corresponding to one line in the image data that is stored in the RAM 110 that functions as a frame memory is transferred and stored in the data latch circuit 105. At this point, the gradation selection/non-selection decision switch 202 is turned ON, the power source voltage pre-charging switch 203*a* is turned OFF, the decision operation effect-preventing switch 206 is turned ON, the ground voltage application switch 207*a* is turned OFF, and, as a result, the output terminal S1 is at level 0.

At the next timing i.e. timing 2, all of the decision result signals that are output by the decision circuit 101 become high-level (H), irrespective of the image data. As a result, all of the switches 202 are turned OFF, so all of the gradation amplifiers 201 are put in an inactive condition. Also, in order that the voltage when the decision operation is executed should not be applied to the data lines (output terminals S1 to Sn) of the liquid-crystal display device, all of the switches 206 are turned OFF. The condition of the switches at this time time is shown in FIG. 13A.

At the next timing i.e. timing 3, the horizontal signal STB is turned ON, and, in response thereto, the gradation data corresponding to one line in the first data latch circuit 105 is transferred and stored in the second data latch circuit 106. Also, the level shifting/decoding circuit 107 reads gradation data corresponding to one line in the second data latch circuit 106 and selects a gradation in accordance therewith by using the switch 205. Specifically, the gradations to be employed in regard to the n respective output lines are selected and other gradations are put in non-selected condition. In addition, at this time, the switch 203*a* is turned ON and, as a result, the line Vn is pre-charged to the power source voltage VDD. The conditions of the switches at this time are as shown in FIG. 13B.

At the next timing i.e. timinig 4, the switch 203*a* is turned OFF, and the switch 207*a* is turned ON. As a result, the line Vn whose the gradation selection switch 205 that is turned ON (i.e. the output line whereof the gradation voltage delivered from the gradation amplifier 201 is decided to be "used") is lowered from the power source voltage VDD to the ground level GND. The condition of the switches at this time is that shown in FIG. 13C.

On the other hand, the power source voltage VDD of lines Vn whose gradation selection switch 205 was turned OFF (i.e. output lines whereof gradation voltage delivered from the gradation amplifier 201 was decided to be "not used") is held without alteration. The condition of the switches at this time-point is that shown in FIG. 13D.

At this timing 4, the voltage level of each 64 lines that are connected with the gradation amplifier circuit 104 may be held as "1", in case that the Vn line is, for example, power source voltage VDD. The voltage levels of the 64 lines may be held as "0", in case that the Vn lines is, for example, ground voltage GND . The decision circuit 101 may therefore be constituted by a latch circuit.

At the next timing i.e. timing 5, the switch 207*a* is turned OFF. At the next timing i.e. timing 6, the switch 206 is turned ON and the gradation amplifiers 201 are respectively connected with the output terminals S1 to Sn. At this time, the gradation amplifiers 201 are maintained in the inactive condition in accordance with the decision result from the decision circuit 101 or altered to the activated condition. The gradation voltages in accordance with the gradation data are thereby applied to each data line through the output terminals S1 to Sn.

In general, it is desirable that the voltage that is supplied to respective parts by the data line drive circuit for the liquid-crystal display device should be held as far as possible fixed, except when the voltage level fluctuates due to, for example, changeover of the operational condition. In view of this aspect, as described above, in the case of the data line drive circuit (incorporating RAM) of FIG. 12, it is necessary for the decision operation effect-preventing switch 206 to be put in the OFF condition during execution of the gradation selection/non-selection decision operation in a single horizontal synchronization period (1 H). During this condition, the output terminals S1 to Sn therefore assume a high impedance (Hi-Z) condition. Specifically, a high-impedance (Hi-Z) period is generated. As a result, the period during which a constant voltage is maintained is decreased by the extent of the Hi-Z period. In order to compensate for this decrease, it is necessary to raise the operating speed of these circuits by improving the drive capability of the gradation amplifiers 201 or gradation voltage selection circuit 108. Therefore, the current consumption increases and the area of the circuitry increases.

In the data line drive circuit of FIG. 12, during the decision action of gradation selection/non-selection, all of the output terminals S1 to Sn (where for example n=396) are inevitably put in the Hi-Z condition. During this action, the gradation voltages cannot therefore be applied to all of the pixels of the liquid-crystal panel. This means that the charging period in respect of the capacitance of the pixels of the liquid-crystal panel becomes shorter, thereby lowering picture quality. In order to avoid this, the need is produced to raise the operating rate by increasing the drive capacity of the gradation amplifiers 201 and/or gradation voltage selection circuit 108 by an amount corresponding to the shortening of the charging time in respect of the capacitances of the pixels of the liquid-crystal panel.

In this way, in the case of the data line drive circuit of FIG. 12, the data line drive circuit incorporates RAM 110, and reduction in current consumption is aimed at by disabling the operation of the gradation amplifiers 201 corresponding to the gradations that are not selected and corresponding to incorporation of the RAM 110. However, picture quality is thereby reduced.

It has now been discovered that in the conventional drive circuit, in order to prevent a lowering of picture quality, it is necessary to increase the operation speed of the gradation amplifiers and/or gradation voltage selection circuit; this is associated with an increase in current consumption or increase in area of the circuitry.

SUMMARY OF THE INVENTION

According to one aspect of the present invention, there is provided a drive circuit for a display device, in which a plurality of scanning lines and a plurality of data lines are arranged in matrix fashion, the drive circuit comprising a first data latch circuit that holds image data corresponding to one line from desired image data; a second data latch circuit that holds image data held in the first data latch circuit; a decoding circuit that ecodes the image data held in the second data latch circuit; a gradation amplifier circuit comprising a plurality of gradation amplifiers that amplify or buffer, and output, a respective plurality of gradation voltages; a gradation voltage selection circuit that selects gradation voltages that are necessary for display, of the plurality of gradation voltages that are output from the gradation amplifier circuit, and outputs these selected gradation voltages to an output circuit; a decision circuit that decides on use/non-use of gradations necessary for display, using the image data that is held in the first data latch circuit or the second data latch circuit, or the image data that is decoded by the decoding circuit; and an enabling/disabling circuit that selectively disables operation of the gradation amplifiers corresponding to gradations that are decided as not to be used, using the decision results output from the decision circuit.

Therefore, the gradation voltages are unaffected by the operation of the gradation voltage selection circuit or output circuit (these are both high-voltage circuits). The selection/non-selection decision operation in respect of gradations can therefore be performed without a Hi-Z condition being generated. In particular, this is suitable in the case of a drive circuit that incorporates RAM that operates as a frame memory.

Also, since no Hi-Z condition is generated, the problem of the period for which a constant voltage is maintained being reduced by the extent of the Hi-Z period does not occur. The reduction in picture quality that accompanied the decision action therefore does not take place. As a result, there is no need for example to raise the drive capacity of the plurality of the gradation amplifiers or the gradation voltage selection circuit in order to increase their rate of operation. Reduction of the current consumption and reduction of the area of the circuitry can thereby be achieved.

This drive circuit employs "switch drive" as described above.

According to one aspect of the present invention, there is provided a drive circuit for a display device, in which a plurality of scanning lines and a plurality of data lines are arranged in matrix fashion, the drive circuit comprising a first data latch circuit that holds image data corresponding to one line from desired image data;

a second data latch circuit that holds image data held in the first data latch circuit;

a decoding circuit that decodes the image data held in the second data latch circuit;

a gradation amplifier circuit comprising a plurality of gradation amplifiers that amplify or buffer, and output, a respective plurality of gradation voltages; a gradation voltage selection circuit that selects gradation voltages that are necessary for display, of the plurality of gradation voltages that are output from the gradation amplifier circuit, and outputs these selected gradation voltages to an output circuit; a plurality of amplifiers that amplify or buffer, and output, the gradation voltages selected by the gradation voltage selection circuit; a decision circuit that decides on use/non-use of gradations necessary for display, using the image data that is held in the first data latch circuit or the second data latch circuit, or the image data that is decoded by the decoding circuit; and an enabling/disabling circuit that selectively disables operation of the gradation amplifiers corresponding to gradations that are decided as not to be used, using the decision results output from the decision circuit.

Therefore, the gradation voltages are unaffected by the operation of the gradation voltage selection circuit or output circuit (these are both high-voltage circuits). The selection/non-selection decision operation in respect of gradations can therefore be performed without a Hi-Z condition being generated. In particular, this is suitable in the case of a drive circuit that incorporates RAM that operates as a frame memory.

Also, since no Hi-Z condition is produced, the problem of diminution of the period for which fixed voltage is held, by the amount of the Hi-Z period, does not arise. The lowering of image quality that occurs accompanying the decision operation therefore does not take place. It therefore becomes unnecessary to raise the operating rate of the plurality of gradation amplifiers and/or the gradation voltage selection circuits by for example increasing their drive capacity. A reduction in current consumption and reduced circuit area can thereby be achieved.

For this drive circuit, "amplifier drive" as referred to above is adopted.

With the drive circuit for a display device according to the present invention, the decision operation of selection/non-selection of gradation can be performed without generating a Hi-Z condition. The drive circuit for a display device according to present invention is suitable for a drive circuit incorporating a frame memory. Also, a further reduction in current consumption and decrease in circuit area can be achieved.

BRIEF DESCRIPTION OF THE DRAWINGS

The above and other objects, advantages and features of the present invention will be more apparent from the following description taken in conjunction with the accompanying drawings, in which.

DESCRIPTION OF THE PREFERRED EMBODIMENTS

Preferred embodiments of the present invention are described below in detail with reference to the appended drawings. Examples in which the present invention is applied to a liquid-crystal display device will be described. However, the present invention is not restricted to a liquid-crystal display device and could also be applied to other display devices that require a plurality of amplifier drives such as for example an EL (electroluminescent) device or PDP (plasma display panel) device.

First Embodiment

Overall Layout of a Liquid-Crystal Display Device

Figure 2:
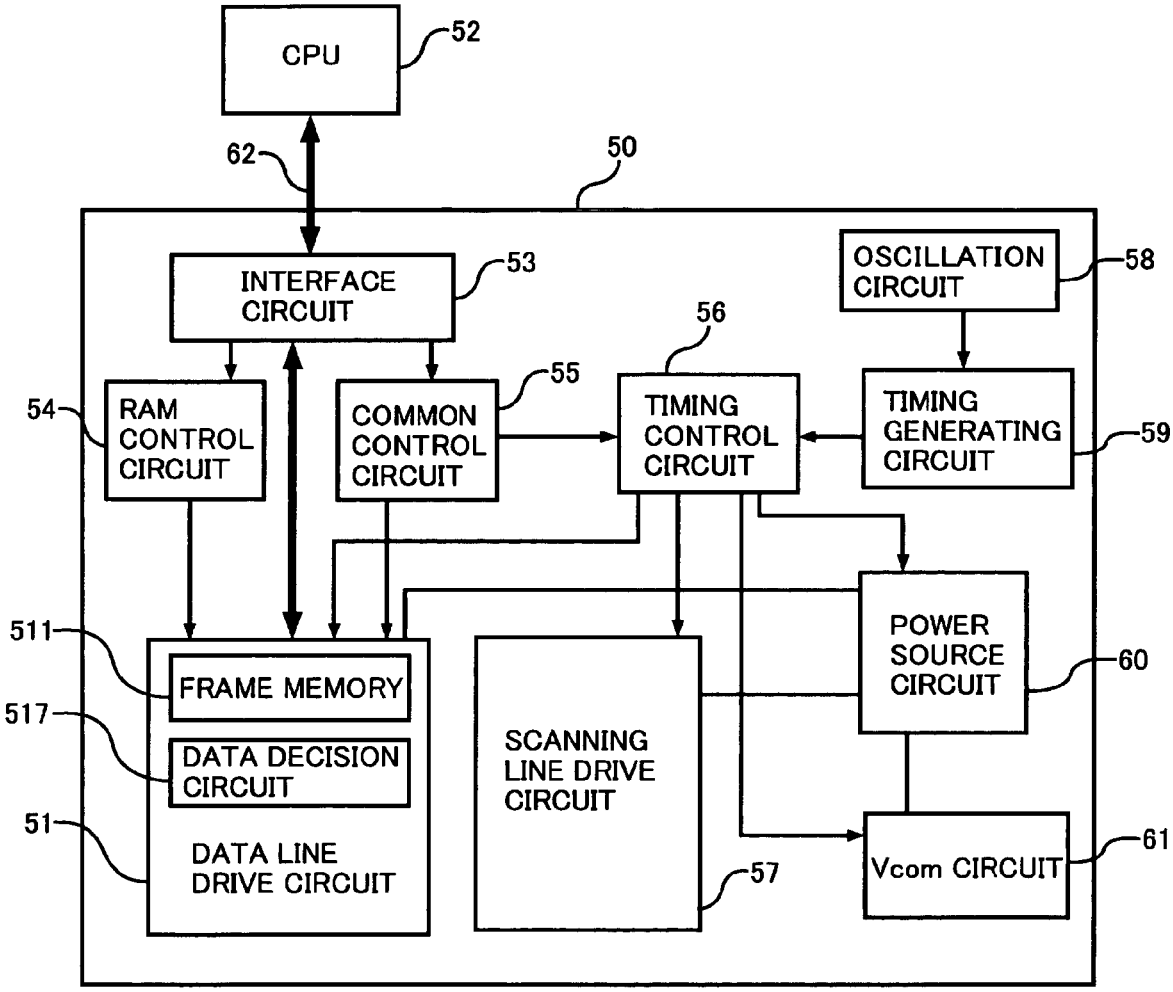
FIG. 2 is a block diagram showing the overall layout of a liquid-crystal display device in which the present invention is adopted.

FIG. 2 is a block diagram showing the overall layout of a liquid-crystal display device to which the present invention is applied.

The liquid-crystal display device 50 of FIG. 2 is provided in a mobile telephone and so on. Although not shown in FIG. 2, it comprises a display unit for displaying a color image. This display unit includes a liquid-crystal layer, a plurality of scanning lines and a plurality of data lines arranged in matrix fashion along this liquid-crystal layer, and a plurality of switching elements that control passage/cut-off of light in respect of each of a prescribed number of pixels formed at the intersections of these scanning lines and data lines. The liquid-crystal display device 50 is connected with a CPU 52 provided on the outside and displays a desired image on the display unit in response to various signals 62 delivered from the CPU 52.

The liquid-crystal display device 50 also comprises a data line drive circuit 51 according to a first embodiment of the present invention, an interface circuit 53, a RAM control circuit 54, a command control circuit 55, a timing control circuit 56, a scanning line drive circuit 57, an oscillation circuit 58, a timing generating circuit 59, a power source circuit 60 and a Vcom circuit 61.

A data line drive circuit 51 according to a first embodiment of the present invention is a circuit for driving a plurality of data lines of the display unit and comprises a frame memory (RAM) 511 and data decision circuit 517.

The interface circuit 53 is employed for connecting the liquid-crystal display device 50 with the CPU 52. The RAM control circuit 54 controls for example the write address of the frame memory (RAM) 511 within the data line drive circuit 51. The command control circuit 55 accepts from the CPU 52 information such as a setting of the gamma circuit required for driving the liquid-crystal display device 50, a drive frequency such as the frame frequency or drive voltage or a number of pixel. The command control circuit 55 stores information that is written to for example an EEPROM (electrically erasable programmable read-only memory), not shown, The command control circuit 55 controls the data line drive circuit 51 and timing control circuit 55 by using commands.

The oscillation circuit 58 constitutes signal-generating means that generates a clock signal RCLK that is unsynchronized with the various signals 62 that are input from the CPU 52 to the interface circuit 63. The timing generating circuit 59 constitutes timing generating means that generates signals such as the vertical signal VS or horizontal signal STB or polarity signal POL, based on the clock signal RCLK that is generated by the oscillation circuit 58. These signals are necessary for driving the liquid-crystal display device 50. The power source circuit 60 generates the drive voltage of the liquid-crystal display device 50. The Vcom circuit 61 is a circuit for driving the common electrode (not shown) of the display unit. The timing control circuit 56 controls the drive timing of the data line drive circuit 51, the scanning line drive circuit 57, the power source circuit 60 and the Vcom circuit 61 in the liquid-crystal display device 50. The scanning line drive circuit 57 is a circuit for driving the plurality of scanning lines of the display unit.

These circuits are not necessarily on the same circuit board: the power source circuit 60 and/or scanning line drive circuit 57 and/or Vcom circuit 61 may be formed on separate circuit boards. Also, some or all of the circuits may be manufactured on for example a glass substrate that comprises the data line and the scannning line. Voltages that drive the data lines, scanning lines and common electrode of the liquid-crystal display device 50 are generated by the power source circuit 60.

It should be noted that, in FIG. 2, the power source line of the logical circuit units such as the signal generating circuit 58 or interface circuit 53 is not shown. Also, apart from the image data and command data, the signals 62 that are input from the CPU 52 comprise for example the chip select signal, write signal, read signal, data/command selection signal, reset signal (none of these are shown); however, all of these are referred to in general as the signals 62.

First Embodiment

Layout of the Data Line Drive Circuit

Figure 1A:
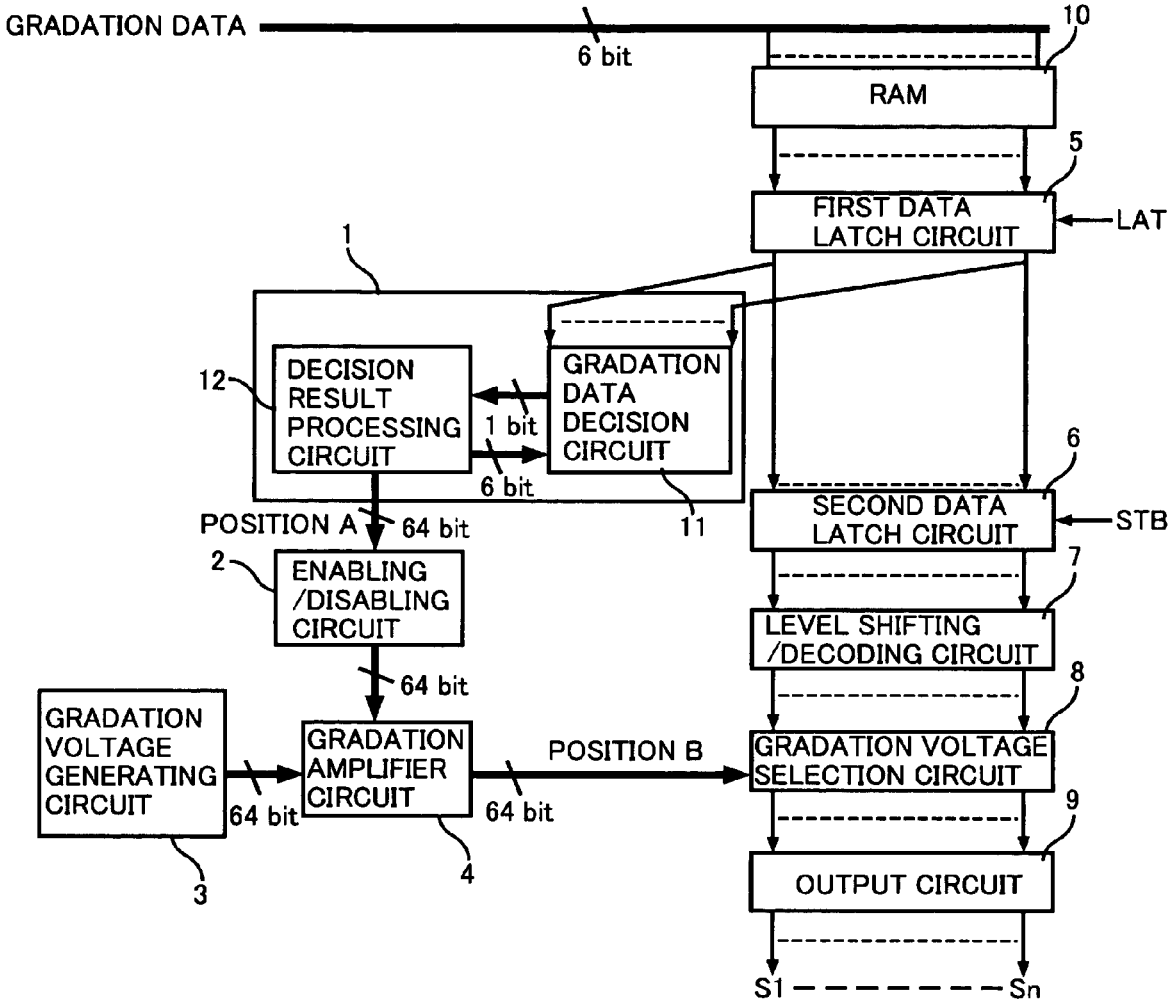
FIG. 1A is a functional block diagram showing the layout of a data line drive circuit according to a first embodiment of the present invention and FIG. 1B is a circuit diagram showing the internal layout of a gradation amplifier circuit employed in this data line drive circuit.
Figure 1B:
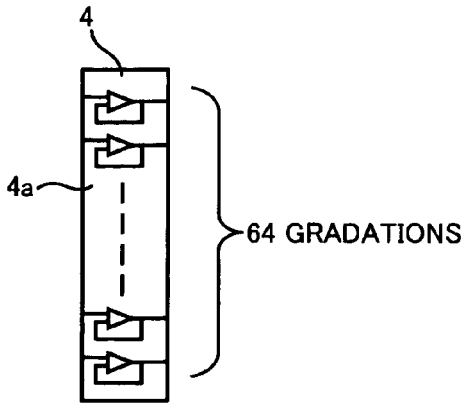

Next, the data line drive circuit 51 relating to the first embodiment of the present invention will be described in detail while referring to FIG. 1A and FIG. 1B. FIG. 1A is a functional block diagram showing the layout of the data line drive circuit 51 and FIG. 1B is a circuit diagram showing the internal layout of the gradation amplifier circuits employed in the data line drive circuit 51.

In an actual data line drive circuit, a polarity inverting circuit and other circuitry are required, but, since these have no direct relationship with the present invention, they are not shown. Also, although what is used in order to display a particular image is the image data constituting the basis of the image, what the present invention is concerned with is the gradation data in the image data and in the following description it is therefore the gradation data that will be described.

The data line drive circuit 51 comprises a decision circuit 1 that functions as an data decision circuit 517, an enabling/disabling circuit 2, a gradation voltage generating circuit 3, a gradation amplifier circuit 4, a first data latch circuit 5 that functions as a line memory, a second data latch circuit 6 that functions as a line memory, a level shifting/decoding circuit 7, a gradation voltage selection circuit 8, an output circuit 9 and RAM 10 that functions as a frame memory 511. N output lines and n output terminals S1 to Sn are provided on the output side of the output circuit 9 (n is an integer of 2 or more). The output terminals S1 to Sn are respectively connected with the n data lines of the display unit.

Figure 11:
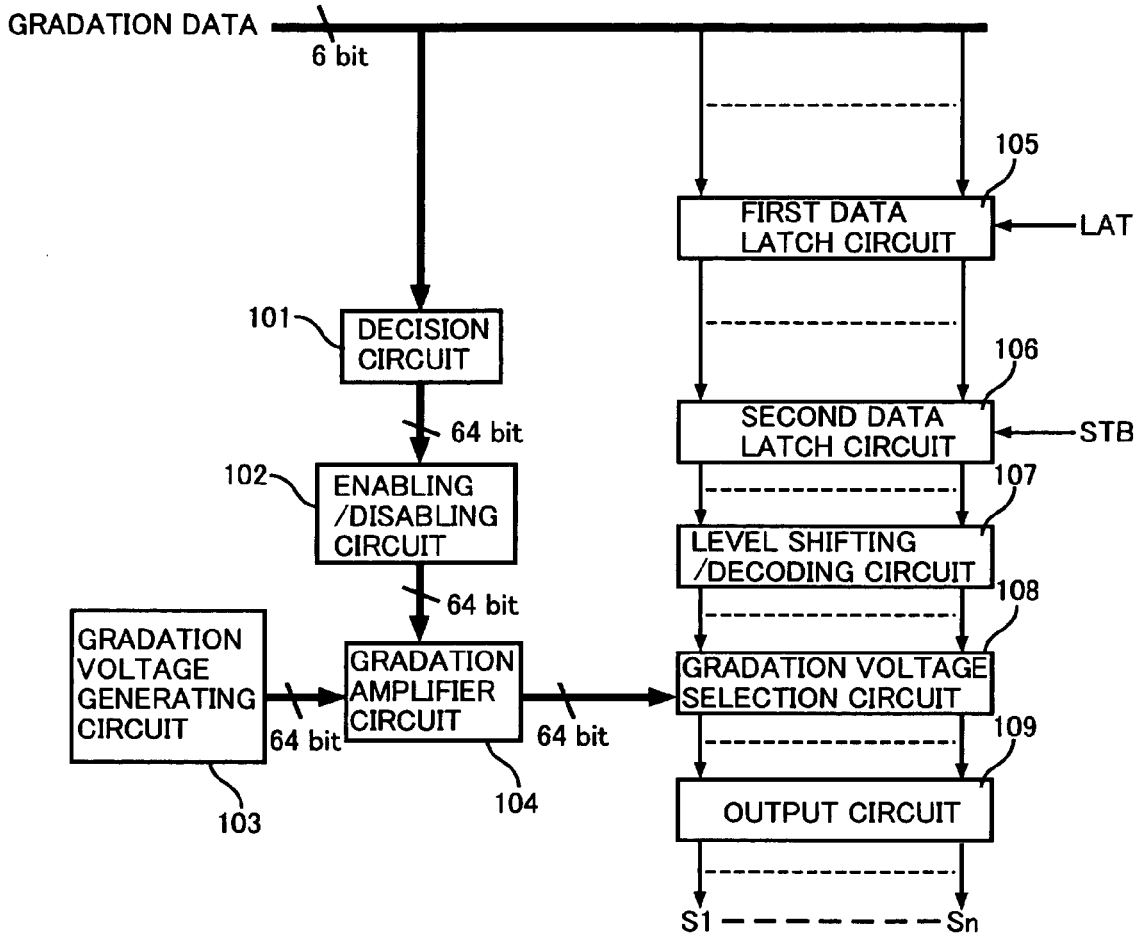
FIG. 11 is a functional block diagram showing the layout of a prior data line drive circuit in which no RAM for a frame memory is incorporated.

In contrast to the circuit in FIG. 11, the decision circuit 1 decides on the gradations to be used on the n output lines, using the 6-bit digital gradation data (corresponding to one line) stored in the first data latch circuit 5 that functions as a line memory. In other words, the decision circuit 1 decides on which of the 64 gradations corresponding to the gradation data that is input at this time-point is to be used on the respective n output lines. The 64-bit decision result data representing the result of the decision is then output. The respective bits of this 64-bit decision result data indicate use/non-use of the corresponding gradations.

The enabling/disabling circuit 2 determines use/non-use of the respective gradations in accordance with the 64-bit decision result data from the decision circuit 1. The enabling/disabling circuit 2 sends a 64-bit control signal based on this result to the gradation amplifier circuit 4. The gradation amplifier circuit 4 generates analogue gradation voltages (V1 to V64) of the same number as the number of gradations (in this case, 64 gradations) of the gradation voltages that are generated by the gradation voltage generating circuit 3. The analogue gradation voltages of these 64 gradations are then delivered to the gradation voltage selection circuit 8.

The gradation amplifier circuit 4 comprises 64 gradation amplifiers 4*a*, of the same number as the number of gradations, as shown in FIG. 1B and respectively amplifies (or buffers) the 64 gradation voltages delivered from the gradation voltage generating circuit 3. The operation of these gradation amplifiers 4*a* is controlled in accordance with the 64-bit control signals that are delivered from the enabling/disabling circuit 2. Specifically, the gradation amplifiers 4*a* corresponding to gradations that are determined to be "used" are allowed to operate, while the operation of the gradation amplifiers 4*a* corresponding to the gradations that are determined as "non-use" is disabled. The purpose of this is to reduce current consumption. The gradation amplifier circuit 4 outputs to the gradation voltage selection circuit 8 analogue gradation voltages whose use/non-use is controlled in this way and which are amplified (or buffered).

The RAM 10 that operates as a frame memory 511 is arranged upstream of the first data latch circuit 5. The RAM 10 stores an amount of 6-bit gradation data input from the outside corresponding to one frame. The RAM 10 sequentially accepts 6-bit gradation data delivered from the CPU 52 through the interface 53 and accumulates an amount of gradation data corresponding to one frame. This accumulation of gradation data is performed in accordance with a gradation data write signal that is delivered from the CPU 52. But this gradation data write signal is not synchronized with both the latch signal LAT and the horizontal signal STB.

The first data latch circuit 5 and the second data latch circuit 6 both function as line memories. The gradation data corresponding to one scanning line (corresponding to n output lines) in the gradation data corresponding to one frame that is stored in the RAM 10 is transferred to the first data latch circuit 5 simultaneously in synchronization with the latch signal LAT and is held in the first data latch circuit 5. Also, an amount corresponding to one scanning line (corresponding to n output lines) held in the first data latch circuit 5 is transferred to the second data latch circuit 6 simultaneously in synchronization with the horizontal signal STB and is held in the second data latch circuit 6. Holding of this gradation data by the second data latch circuit 6 is continued for a single horizontal period (1 H).

The first data latch circuit 5 is provided to ensure that, if a gradation data write signal to the RAM 10 delivered from the CPU and a latch signal LAT are delivered in a time-wise overlapping fashion, writing to the RAM 10 is executed with priority.

The level shifting/decoding circuit 7 performs level shift the 6-bit gradation data (corresponding to one scanning line) delivered from the second data latch circuit 6 for each of the n output lines and identifies the gradation that is to be selected by decoding thereof to the 64-bit gradation data. The gradation voltage selection circuit 8 selects a analogue gradation voltage (V1 to V64) for each of the output lines, in accordance with the result of the identification process performed by the level shifting/decoding circuit 7. The output circuit 9 respectively outputs the analogue gradation voltages that have thus been selected to the n output terminals S1 to Sn.

First Embodiment

Layout and Operation of the Decision Circuit

Next, the layout and operation of the decision circuit 1 employed in the data lines drive circuit 51 will be described with reference to FIG. 4.

Figure 4:
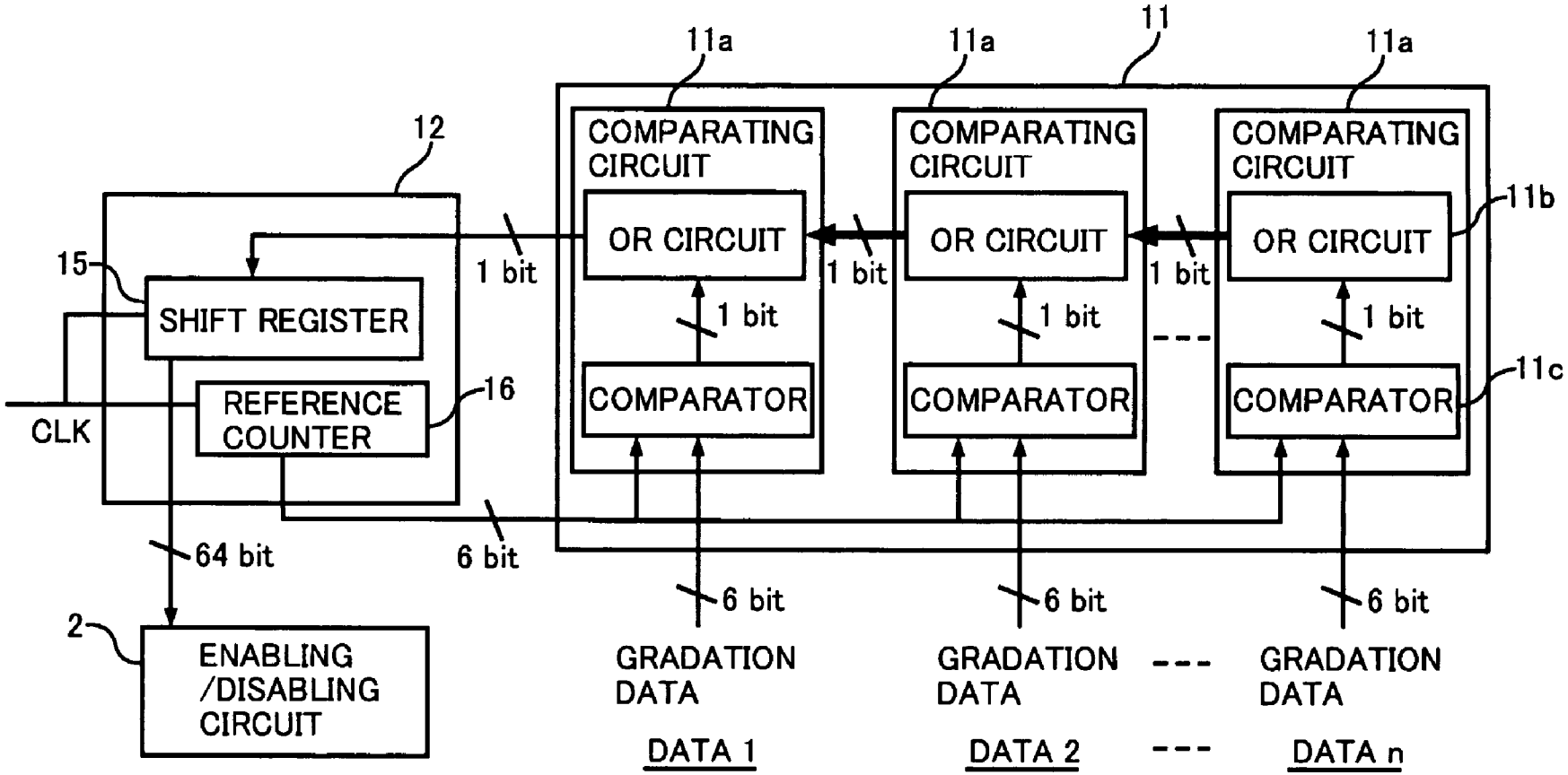
FIG. 4 is a functional block diagram showing the layout of a decision circuit employed in a data line drive circuit according to a first embodiment of the present invention.

As shown in FIG. 4, the decision circuit 1 comprises a gradation data decision circuit 11 and a decision result processing circuit 12. The gradation data decision circuit 11 comprises n comparating circuits 11*a* having the same construction. These n comparating circuits 11*a* respectively comprise a 1-bit OR circuit 11*b* and a 6-bit comparator 11*c*. The n comparating circuits 11*a* are cascaded in a single row. The decision result processing circuit 12 comprises a 64-bit shift register 15 and a 6-bit reference counter 16. The shift register 15 and the reference counter 16 are operated synchronized with the clock signal CLK.

The reference counter 16 of the decision result processing circuit 12 supplies one of the counter values 0 to 63 to all of the comparators 11*c* in order in 6-bit form. On the other hand, the comparators 11*c* are respectively supplied with corresponding 6-bit gradation data DATA1 to DATAn (these are stored in the first data latch circuit 5). The comparators 11*c* compare the 6-bit counter values and the 6-bit gradation data DATA1 to DATAn which are thus supplied and generate 1-bit comparison result data, which they deliver to the corresponding OR circuit 11*b*.

As shown in FIG. 4, the nth comparating circuit 11*a* outputs the 1-bit comparison result data from its own comparator 11*c* forward directly to the adjacent comparating circuit 11*a* (i.e. the (n−1)-th comparating circuit) as 1-bit comparison result data. The (n−1)-th OR circuit 11*b* takes the OR of the 1 bit comparison result data from its own comparator 11*c* and the 1-bit OR output (this is equal to the output of the nth comparator 11*c*) of the nth comparating circuit 11*a* that is adjacent thereto backward and outputs this result to the (n−2)-th comparating circuit 11*a* that is adjacent thereto in the forward direction. Subsequently in the same way, the (n−2)-th to second OR circuits 11*b* respectively take the OR of the 1 bit comparison result data from their own comparator 11*c* and the 1-bit OR output of the (n−1)-th to third comparating circuit 11*a* adjacent thereto in the backward direction and output the result to the (n−3)-th to first comparating circuit 11*a* adjacent thereto in the forward direction. The first OR circuit 11*b* takes the OR of the 1-bit comparison result data from its own comparator 11*c* and the 1-bit OR output of the second comparating circuit 11*a* adjacent thereto in the backward direction and outputs the result to the decision result processing circuit 12 as the 1-bit decision result data of the gradation data decision circuit 11. This 1-bit decision result data is input to the 64-bit shift register 15 of the decision result processing circuit 12.

As a result, when the above operation is repeated 64 times while successively varying the counter value in the range 0 to 63 as 0, 1, 2 . . . , 64 items of 1-bit decision result data are successively stored in the 64-bit shift register 15. By examining these data, decision results indicating which gradations are to be used and which gradations are not to be used, of the 64 gradations, are obtained in 64-bit form.

When the 64-bit data indicating these decision results are delivered to the enabling/disabling circuit 2, the enabling/disabling circuit 2 allows the gradation amplifiers 4*a* that are to be used to operate and inhibits the operation of the gradation amplifiers 4*a* that are not to be used, in accordance with these decision results. Power consumption in the gradation amplifier circuit 4 is thereby reduced.

To describe a specific example, the reference counter 16 supplies the counter value "0" in 6-bit form to the comparating circuits 11*a* in the gradation data decision circuit 11. When this is done, these comparators 11*c* compare this counter value of "0" with the 6-bit gradation data DATA1 to DATAn that are output from the first data latch circuit 5 respectively. If, at this time-point, their own gradation data is "0", and thus agrees with the counter value "0", the 1-bit output of the comparator 11*c* is "TRUE". If the gradation data is other than "0", in other words "1" "2" . . . , the 1-bit output of the comparator 11*c* becomes "FALSE". The comparison operation is performed in the n comparating circuits 11*b* in the same way.

If the counter value is "0", a decision is made as to whether or not the n gradation data for the n output lines are "0". As shown in FIG. 4, the n comparating circuits 11*a* are connected in cascade (i.e. connected in a chain, like a string of beads), with a 64-bit shift register 15 connected at the terminal thereof. A first bit of the shift register 15 is thereby determined. Specifically, the first bit is determined in accordance with whether all of the n gradation data are non-"0" or whether one or more of the n gradation data is "0". Next, if the same operation is performed with the counter value changed to "1", the second bit of the shift register 15 is determined. The 64-bit decision result data in respect of the 64 gradations i.e. "TRUE" (existing gradation i.e. used gradation) or "FALSE" (non-existent gradation i.e. unused gradation) obtained by subsequently repeating this operation in the same way 64 times with the counter value successively changed from "0" to "63" is accumulated in the shift register 15.

"TRUE" or "FALSE" in the decision result data which are thus obtained specify whether the gradation data are used or unused. When these decision result data are sent to the enabling/disabling circuit 2, the enabling/disabling circuit 2 allows the gradation amplifier 4*a* corresponding to the gradation evaluated as "TRUE" to operate and disables the operation of the gradation amplifier 4*a* corresponding to a gradation evaluated as "FALSE".

First Embodiment: Operation of the Data Line Drive Circuit

Figure 3:
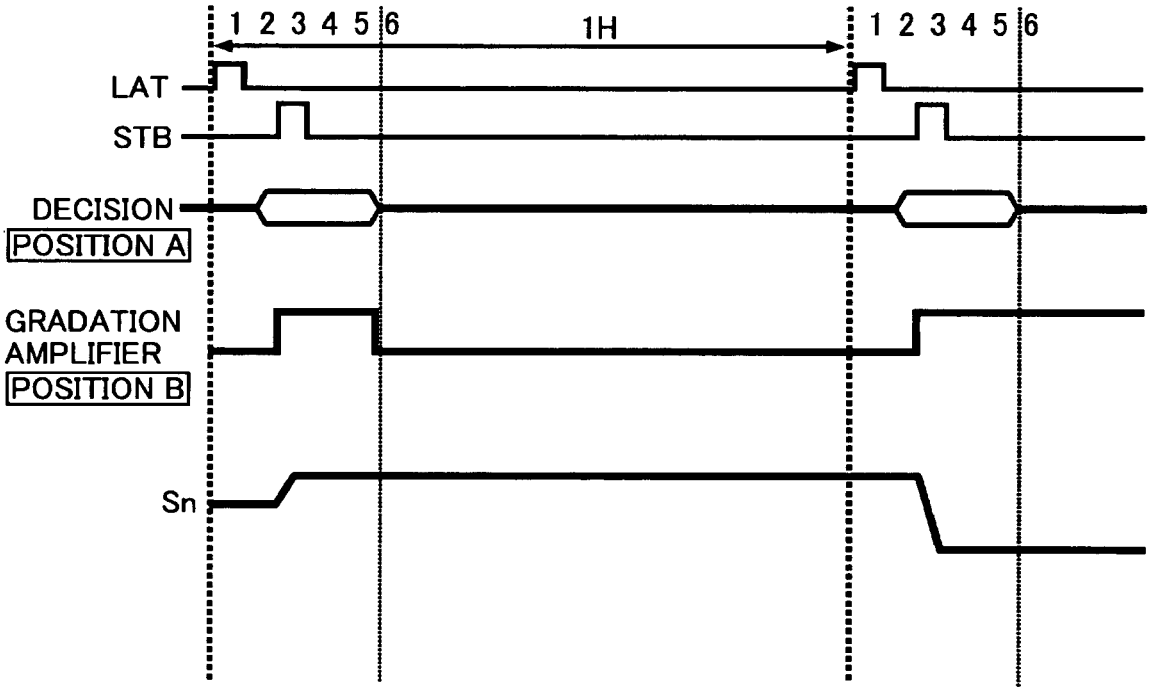
FIG. 3 is a timing chart showing the operation of a data line drive circuit according to a first embodiment of the present invention.

Next, the operation of the data line drive circuit 51 will be described with reference to the timing chart shown in FIG. 3. It should be noted that, for simplicity in display, only the waveform associated with the output terminal Sn in FIG. 3 is shown. The position A shows the voltage level of the output terminal of the decision circuit 1 and the position B shows the voltage level of the output terminal of the gradation amplifier circuit 4 (see FIG. 1).

First of all, when the latch signal LAT is turned ON with the timing 1 of FIG. 3 (included in the initial horizontal synchronization period 1 H), in response thereto, an amount corresponding to one line of the gradation data in the image data stored in the RAM 10 that functions as frame memory is transferred to the first data latch circuit 5 and stored. The output levels of the totality of gradation amplifiers 4*a*, including the illustrated gradation amplifiers 4*a* are then the output results on the previous occasion (not shown in the drawings), continuing from the left-hand side of this timing chart. This represents the operation of the immediately preceding line and has no effect at all on the operation of the current (and subsequent) lines.

Next, at the timing 2, the decision circuit 1 commences the prescribed decision action. Specifically, while corresponding 6-bit gradation data DATA1 to DATAn are respectively supplied to the comparators 11*c*, the counter values from the reference counter 16 of the decision result processing circuit 12, while being successively changed to 0, 1, 2, . . . , are supplied to all of the comparators 11*c*. As a result, the 64-bit decision result data is stored in the 64-bit shift register 15 of the decision result processing circuit 12. This decision operation is continued until the timing 5 and during this period is conducted in parallel with the operations of timing 3 and 4.

When, at the following timing, namely, timing 3, the horizontal signal STB is turned ON, in response thereto, gradation data corresponding to one line in the first data latch circuit 5 is transferred to the second data latch circuit 6 and stored. Also, the level shifting/decoding circuit 7 reads an amount of gradation data corresponding to one line in the second data latch circuit 6 and selects a gradation in accordance therewith. Specifically, the gradations to be used are selected for each of the n respective output lines and gradations other than these are deemed to be non-selected. At this point, the output levels of the totality of gradation amplifiers 4*a* including the illustrated gradation amplifiers 4*a* are always set to H. All the gradation amplifiers 4*a* are therefore put into an active condition and the voltage levels of the output terminals Sn become analogue gradation voltages.

At the following timing 4 and at timing 5, the decision operation of the decision circuit 1 is still continued, so the condition of the gradation amplifiers 4*a* and the output terminals Sn is held at the condition in timing 3. The decision operation terminates at the end of timing 5.

At the next timing, timing 6, the decision operation of the decision circuit 1 has already terminated, so, in accordance with the decision results, the activated condition (operating condition) of the gradation amplifiers 4*a* is maintained, or is altered to an inactivated condition (disabled condition). Analogue gradation voltages corresponding to the gradation data are thus applied to the data lines of the liquid-crystal display device 50 through the output terminals S1 to Sn. It should be noted that, since the illustrated gradation amplifiers 4*a* have been identified as non-used, operation thereof is disabled and as a result can have no effect on the voltage level of the output terminal Sn. Also, although not shown, since operation of the gradation amplifiers 4*a* that have been identified as non-used is disabled, their output levels are of course L.

In the second horizontal synchronization period H of FIG. 3, at the timing 3, all of the gradation amplifiers 4*a* are changed from the non-activated condition to the activated condition. Even in this case, the result does not affect the voltage level of the output terminal Sn. Parenthetically the reason why the voltage level of the output terminal Sn is negative is because, since the second horizontal synchronization period H has been entered, the polarity of the applied voltage has been inverted compared with the first horizontal synchronization period H.

As described above, with the data line drive circuit 51 according to the first embodiment of the present invention, the decision circuit 1 decides upon use/non-use of the various gradations by using the 6-bit gradation data transferred from the first data latch circuit 5. The operation of the second data latch circuit 6 and/or the group of circuits downstream therefrom i.e. the level shifting/decoding circuit 7 and gradation voltage selection circuit 8 and output circuit 9 (all of these are high-voltage circuits) is therefore not affected. The operation of selection/non-selection of gradations can therefore be performed without generating a Hi-Z condition even in the case where RAM 10 that operates as frame memory 511 is incorporated.

Figure 12:
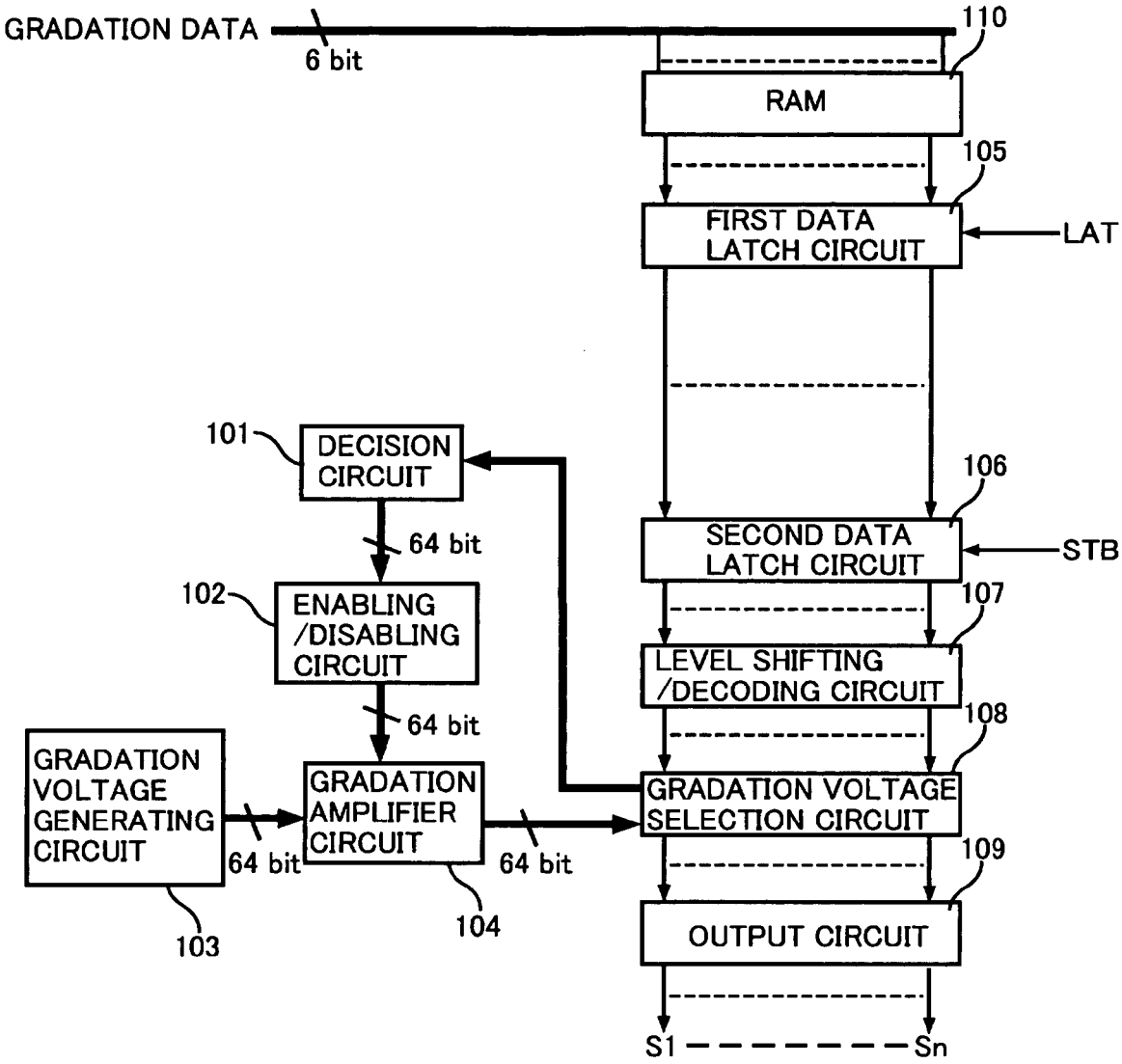
FIG. 12 is a functional block diagram showing the layout of a data line drive circuit in which RAM frame memory is incorporated, employed in a drive circuit of a conventional display device.
Figure 13A:
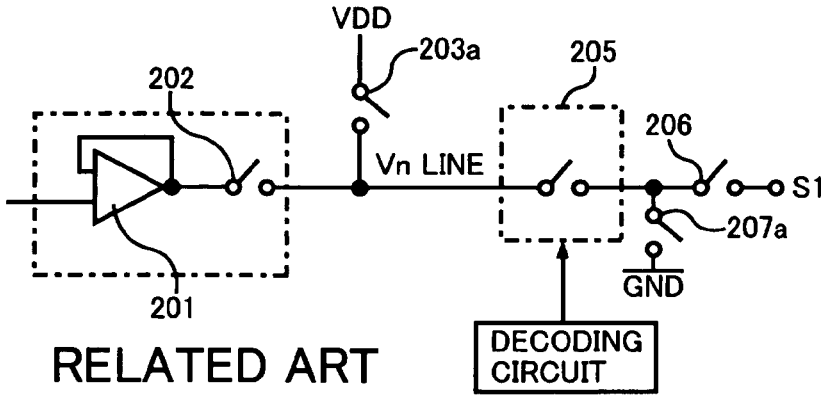
FIG. 13A to FIG. 13D are detail functional block diagrams showing an example of the layout of a decision circuit employed in the data line drive circuit of FIG. 12 and its changes of state.
Figure 13B:
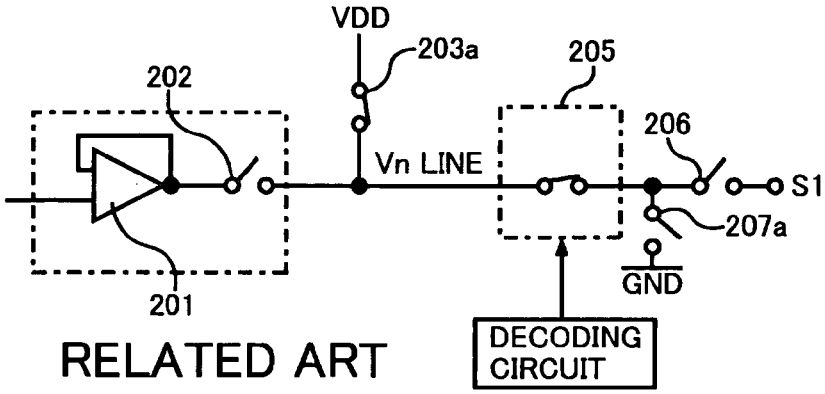
RELATED ART Fig. 13B
Figure 13C:
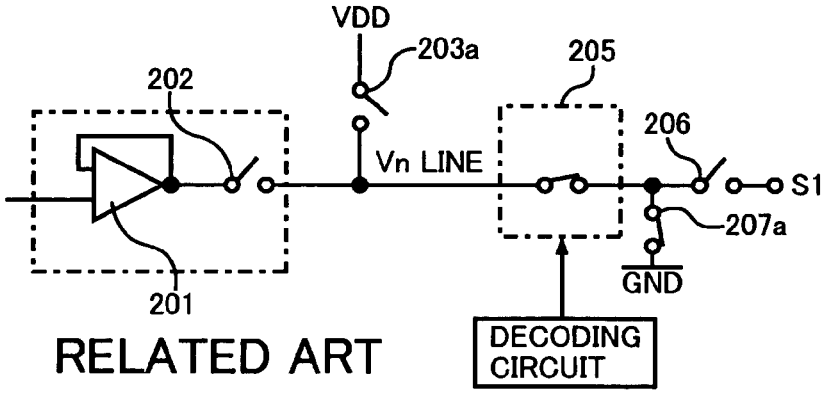
RELATED ART Fig. 13C
Figure 13D:
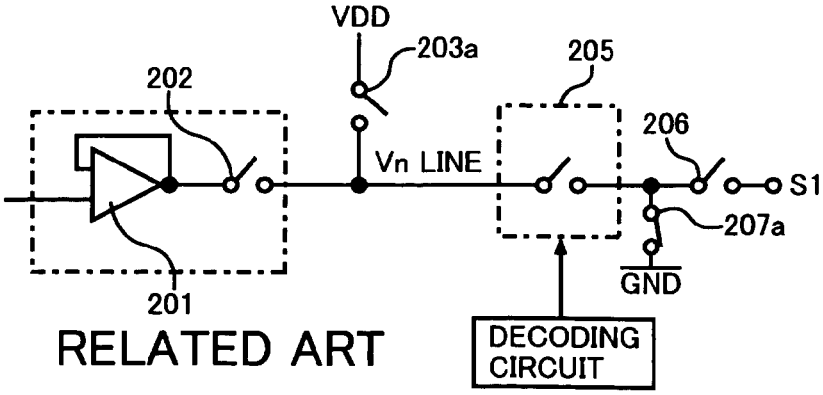
RELATED ART Fig. 13D
Figure 14:
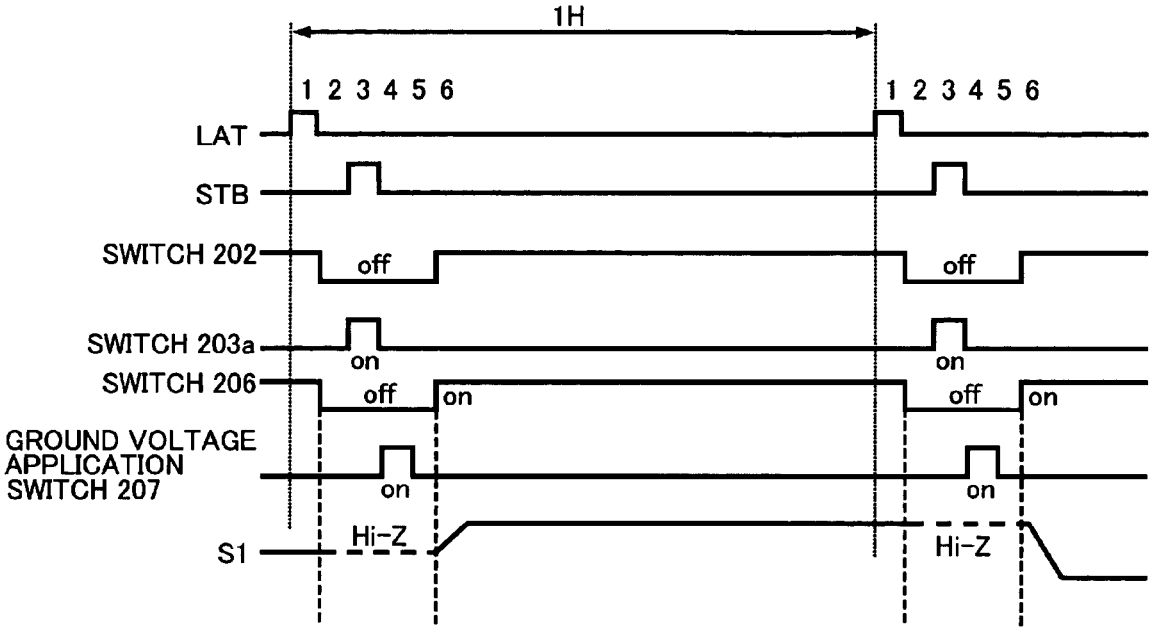
FIG. 14 is a timing chart showing the operation of the data line drive circuit of FIG. 12.

Also, since the Hi-Z condition is not generated, the problem of the period for which the constant voltage is held being reduced by the amount of the Hi-Z period cannot arise. Specifically, since the problem of the data line drive circuit shown in FIG. 12 does not arise, the deterioration in image quality that accompanies the decision operation does not take place. As a result, the need to raise the operating rate of the 64 gradation amplifiers 4*a* and/or gradation voltage selection circuit 8 by for example improving their drive capacity is eliminated, so a reduction in current consumption and a decrease in circuit area can be achieved.

For example, let us assume that 0.64 mA (0.01 mA per one gradation) is consumed in the generation of the 64 gradation voltages in the gradation voltage generating circuit and that 6.4 mA (0.1 mA per one gradation) is consumed in the amplification or buffering of these gradation voltages in the gradation amplifier circuit 4. By disabling the generation of gradation voltages corresponding to non-used gradations, and the amplification or buffering thereof, in accordance with the decision results of the decision circuit 1, current consumption is cut by an amount of (0.01+0.1)=0.11 mA per one gradation. Assuming that the drive voltage is 5V, in the case for example of a full screen signal-color display, a cut of current consumption of a maximum of 0.11 mA×5V×63=34.65 mW can be achieved.

Second Embodiment

Figure 5:
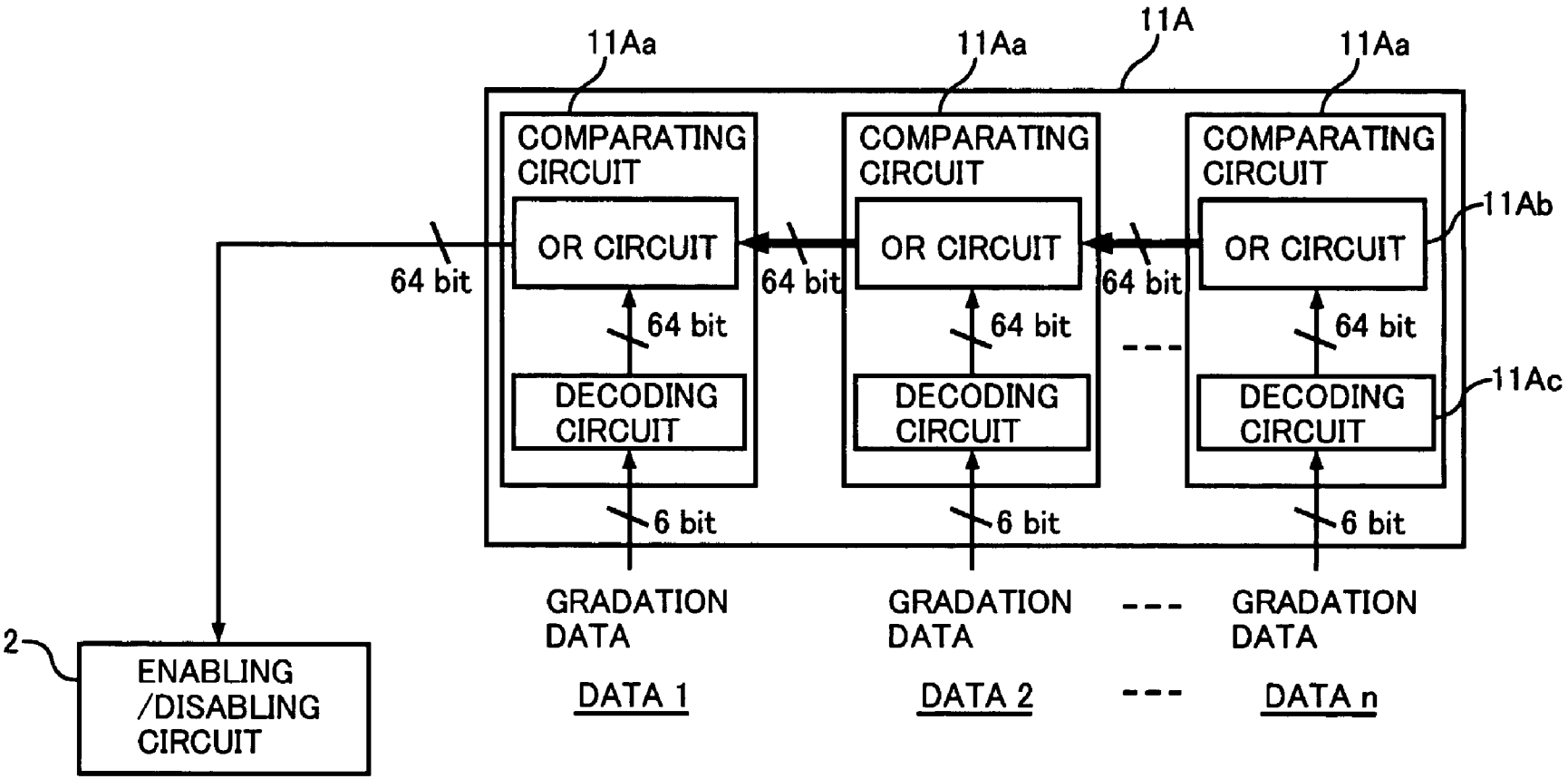
FIG. 5 is a functional block diagram showing the layout of a decision circuit employed in a data line drive circuit according to a second embodiment of the present invention.

FIG. 5 shows the layout of a decision circuit 1 employed in a data line drive circuit according to a second embodiment of the present invention.

As shown in FIG. 5, this decision circuit 1 is constituted solely of a gradation data decision circuit 11A and does not include a circuit corresponding to the decision result processing circuit 12 in the first embodiment. The gradation data decision circuit 11A includes n comparating circuits 11Aa having mutually identical circuit constructions. These n comparating circuits 11Aa respectively comprise 64-bit OR circuits 11Ab and decoding circuits 11Ac that convert six bits to 64 bits, and are cascade-connected in a single row.

The n decoding circuits 11Ac respectively convert the 6-bit gradation data DATA1 to DATAn received from the first data latch circuit 5 to 64-bit form. Specifically, the n decoding circuits 11Ac determine the bit (amount corresponding to 1 bit) corresponding to the selected gradation of the 64 gradations, and the bits (amount corresponding to 63 bits) corresponding to the non-selected gradations, using the 6-bit gradation data. In other words, of the 64 bits, only the single bit that is selected as the used gradation is of a different level to that of the other 63 bits. The result determined by the decoding circuit 11Ac is then output to its own OR circuit 11Ab in the form of 64-bit selection/non-selection data.

The nth OR circuit 11Ab then directly outputs the 64-bit selection/non-selection data from its own decoding circuit 11Ac to the comparating circuit 11Aa that is adjacent thereto in the forward direction (i.e. the (n−1)-th comparating circuit) in the form of a 64-bit OR output. The (n−1)-th OR circuit 11Ab then takes the OR of the 64-bit selection/non-selection data from its own decoding circuit 11Ac and the 64-bit OR output of the nth comparating circuit 11*a* that is adjacent thereto in the downstream direction (this is equal to the output of the nth OR circuit 11Ac), and outputs the result to the (n−2)-th comparating circuit 11Aa that is adjacent thereto in the forward direction. After this, likewise, the (n−2)-th to second OR circuits 11Ab respectively take the OR of the 64-bit selection/non-selection data from their own OR decoding circuits 11Ac and the 64-bit OR output of the (n−1)-th to third comparating circuits 11Aa that are adjacent thereto in the backward direction and output this result to the (n−3)-th to first comparating circuits 11*a* that are adjacent thereto in the forward direction. The first OR circuit 11Ab takes the OR of the 64-bit selection/non-selection data from its own decoding circuit 11Ac and the 64-bit OR output from the second comparating circuit 11Aa that is adjacent thereto in the backward direction and outputs this result to the enabling/disabling circuit 2 as 64-bit decision result data of the gradation data decision circuit 11A.

The OR of the outputs of the OR circuits 11Ab in all of the comparating circuits 11Aa is reflected in the 64-bit decision result data (output from the first comparating circuit 11Aa) obtained by this calculation. Consequently, by employing this, a decision of use/non-use of the gradations can be achieved in respect of the n output lines.

Continuing the description with reference to a specific example, the 6-bit gradation data from the first data latch circuit 5 are decoded by the decoder circuit 11Ac. If, at this time-point, the value of this gradation data is for example "0", the "zeroth bit" of the 64-bit selection/non-selection data that is output by the decoder circuit 11Ac in question becomes "TRUE" and all the other 63 bits of this data become "FALSE". If the value of this gradation data is "1", the "first bit" of the 64-bit selection/non-selection data that is output by the decoder circuit 11Ac in question becomes "TRUE" and all of the other 63 bits of this data become "FALSE". When the thus-obtained 64-bit selection/non-selection data are superimposed using the 64-bit OR circuit 11Ab, and the OR is taken, if even one of these bits is "TRUE", the 64-bit decision result data becomes "TRUE". That is, which of the "zeroth bit" to "63rd bit" of the 64-bit selection/non-selection data the value of the gradation data that was converted to 64-bit form corresponds to can be ascertained from the 64-bit decision result data.

The decision result data consisting of this group of 64 bits directly represents activation/non-activation of the 64 gradation amplifiers 4*a*. Which of the gradations is to be used/non-used (i.e. which of the gradation amplifiers 4*a* is to be activated/non-activated) can therefore be decided by directly sending this decision result data to the enabling/disabling circuit 2.

The data line drive circuit of the second embodiment is fundamentally the same in construction as the first embodiment described above and it is clear that the same beneficial effect is obtained. However, as shown in FIG. 5, since the decision circuit 1 is constituted solely of the gradation data decision circuit 11A, and includes no decision result processing circuit 12, no shift register 15 or reference counter 16 operated in synchronization with the clock signal CLK is present. Consequently, this embodiment is not subject to the restrictions imposed by the clock signal CLK and, as a result, the decision operation of the decision circuit 1 can be set taking account only of the short delay time of the "transistor operating delay time" generated in the logic circuitry in the gradation data decision circuit 11A. That is, although the size of the circuit is somewhat larger than in the case of the first embodiment, there is the advantage that the decision operation is faster than in the case of the first embodiment.

Third Embodiment

Figure 6:
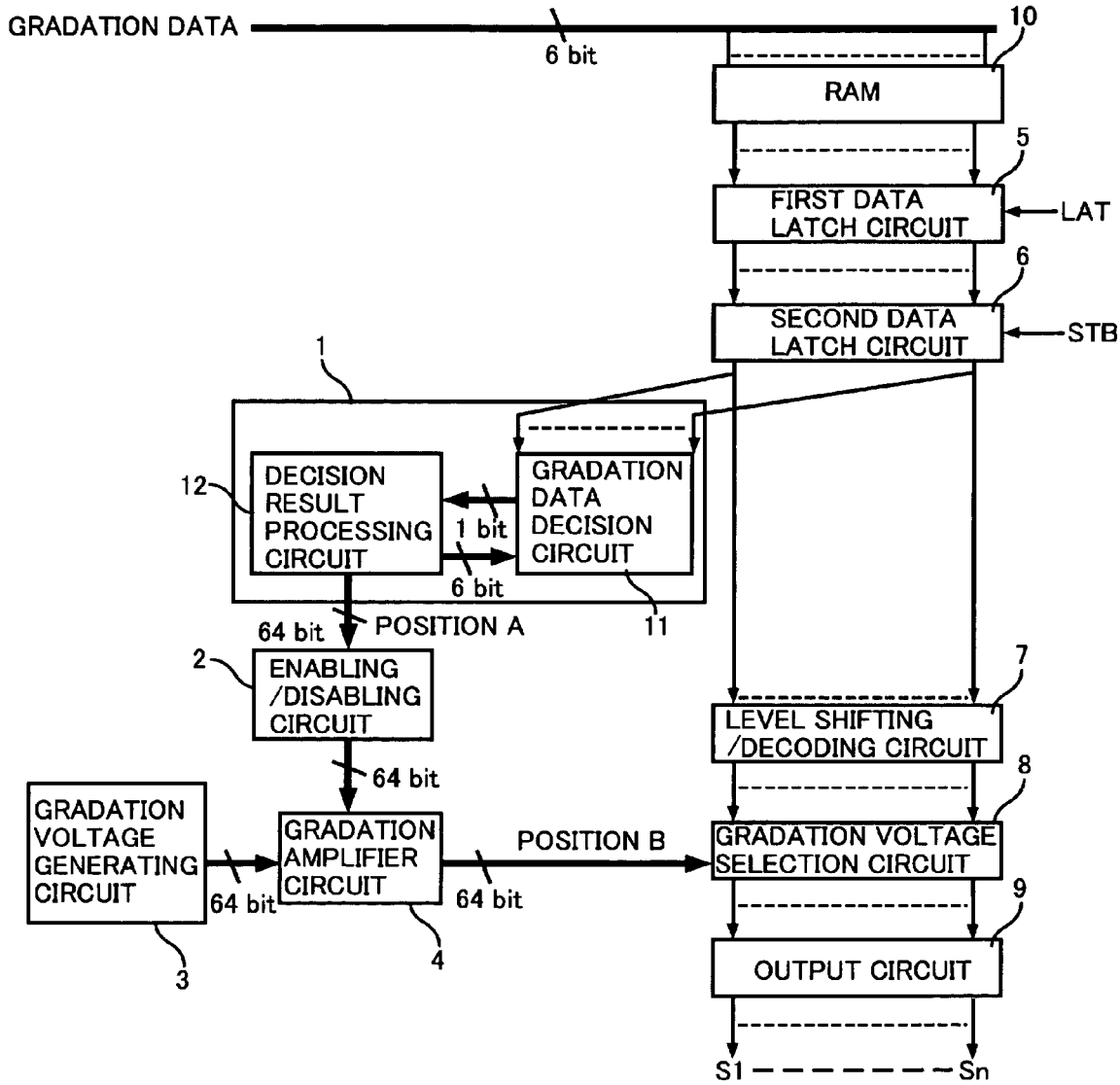
FIG. 6 is a functional block diagram showing the layout of a decision circuit employed in a data line drive circuit according to a third embodiment of the present invention.

FIG. 6 shows the layout of a data line drive circuit according to a third embodiment of the present invention. In the data line drive circuit of this third embodiment, the gradation data that is input to the decision circuit 1 is obtained from within the second data latch circuit 6, but the rest of the construction is the same as in the case of the first embodiment. Identical elements are therefore given the same reference symbols, but detailed description thereof is not repeated.

Figure 7:
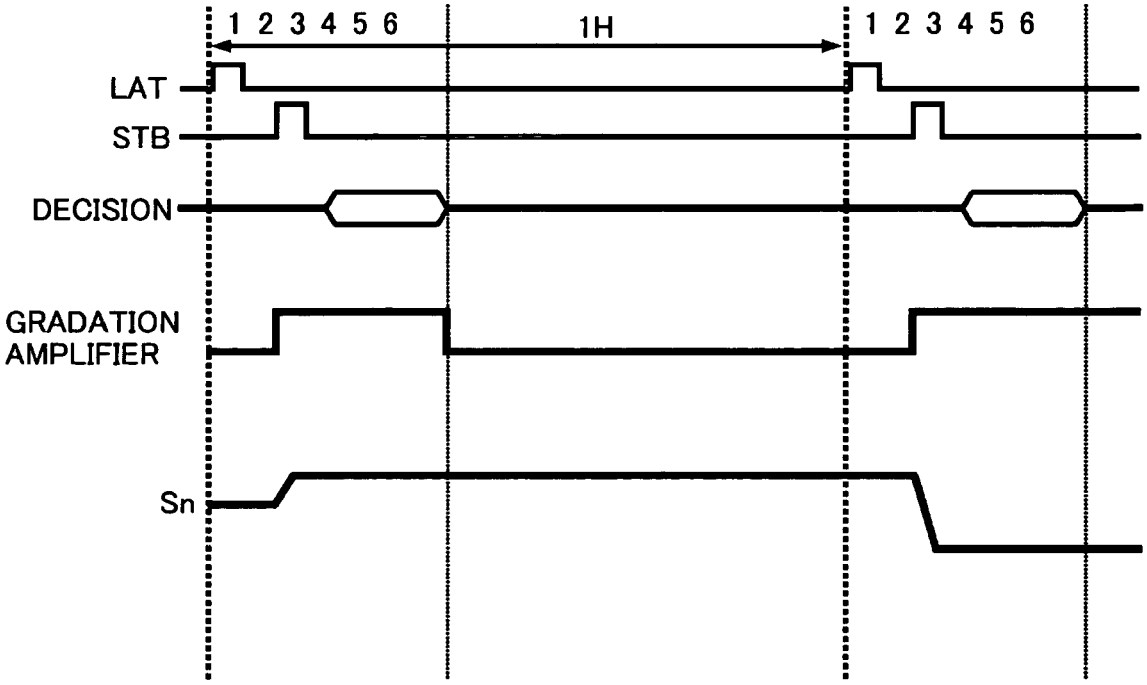
FIG. 7 is a timing chart showing the operation of a data line drive circuit according to a third embodiment of the present invention.

The data flow and operating principles are the same as in the case of the first embodiment. However, as shown in the timing chart of FIG. 7, this embodiment differs from the first embodiment in that the decision operation of the decision circuit 1 is commenced in response to the horizontal signal STB that defines the input timing of the second data latch circuit 6.

It is clear that, with the data line drive circuit of the third embodiment, the same benefits as in the case of the first embodiment described above are obtained. However, considering the overall operation and function in the case where a plurality of gradations are output, there may be cases in which it may not be possible to supply the gradation data extracted from the first data latch circuit 5 to the decision circuit 1. In such cases, as in this third embodiment, the gradation data from the second data latch circuit 6 may be supplied to the decision circuit 1. If this is done, the decision operation commences with a timing later than in the case of that of the first embodiment, so there is the difficulty that there is a risk of the time up to the timing of termination of the decision process whereby disabling of the operation of the various gradation amplifiers 4*a* can be finally determined being lengthened.

Fourth Embodiment

Figure 8:
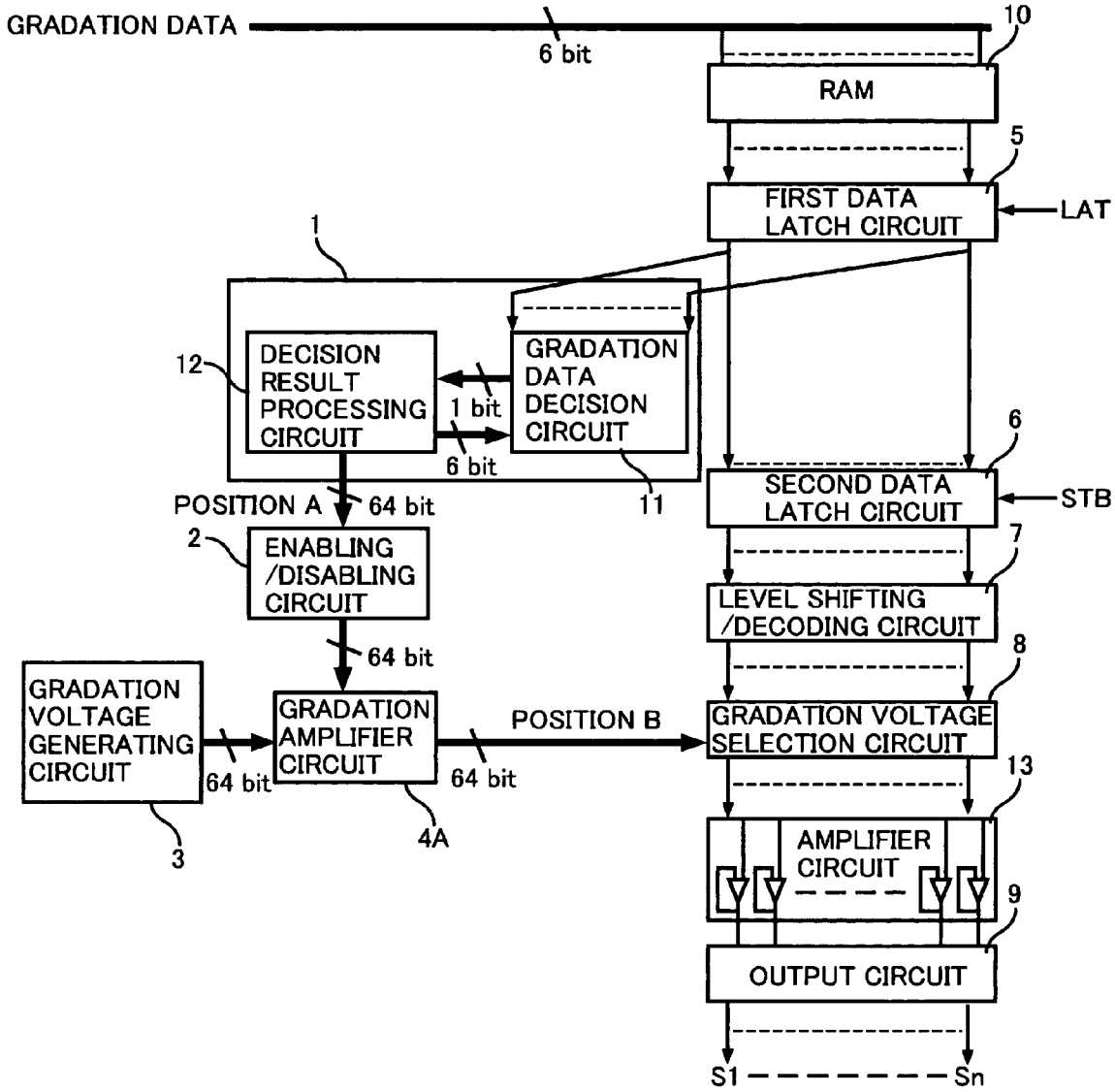
FIG. 8 is a functional block diagram showing the layout of a data line drive circuit according to a fourth embodiment of the present invention.

FIG. 8 shows the layout of a data line drive circuit according to a fourth embodiment of the present invention. The date line drive circuit according to this fourth embodiment differs from the data line drive circuit according to the first to third embodiments in that, whereas, in the first to third embodiments described above, "switch drive" is adopted, in the fourth embodiment "amplifier drive" is adopted. Since the rest of the construction is the same as in the case of the first embodiment, identical elements are given the same reference symbols as in FIG. 1 but a detailed description thereof is not repeated.

Specifically, an amplifier circuit 13 is provided between the gradation voltage selection circuit 8 and the output circuit 9. In the amplifier circuit 13, a construction is adopted in which amplifiers are provided for the respective n output lines and the selected analogue gradation voltage is amplified (or buffered) for each output line. The n amplifiers in the amplifier circuit 13 are always operated, irrespective of the decision results.

64 gradation amplifiers (not shown) are included in the gradation amplifier circuit 4A in the same way as in the case of the first to the third embodiments, but these gradation amplifiers are connected with the amplifier circuit 13. Since a adjusting function for gradation voltage etc is included in the gradation amplifier circuit 4A, the analogue gradation voltages of 64 gradations set in the gradation amplifier circuit 4A are delivered to the amplifier circuit 13, where they are amplified (or buffered).

As is clear from the fourth embodiment, beneficial effects are also obtained when the present invention is applied to "amplifier drive".

Let us for example assume that 0.64 mA (0.01 mA per one gradation) is consumed in the generation of the 64 analogue gradation voltages in the gradation amplifier circuit 4A and that 6.4 mA (0.1 mA per one gradation) is consumed in the amplification of these analogue gradation voltages in the amplifier circuit 13. Reduction in the current consumption of 0.01 mA per one gradation is achieved by disabling generation of analogue gradation voltages corresponding to the unused gradations in accordance with the decision results of the decision circuit 1. This is smaller than the first embodiment, in which the current consumption was 0.11 mA per one gradation. Also, if the drive voltage is assumed to be 5V, a reduction in power consumption of a maximum of 0.01 mA×5V×63=3.15 mW can be achieved in the case for example where the entire screen is displayed in a single color. The amount of reduction of power consumption is rather smaller than in the case of the first embodiment, where this was 34.65 mW. However, power consumption can also be reduced even when the present invention is applied to "amplifier drive".

Fifth Embodiment

Figure 9:
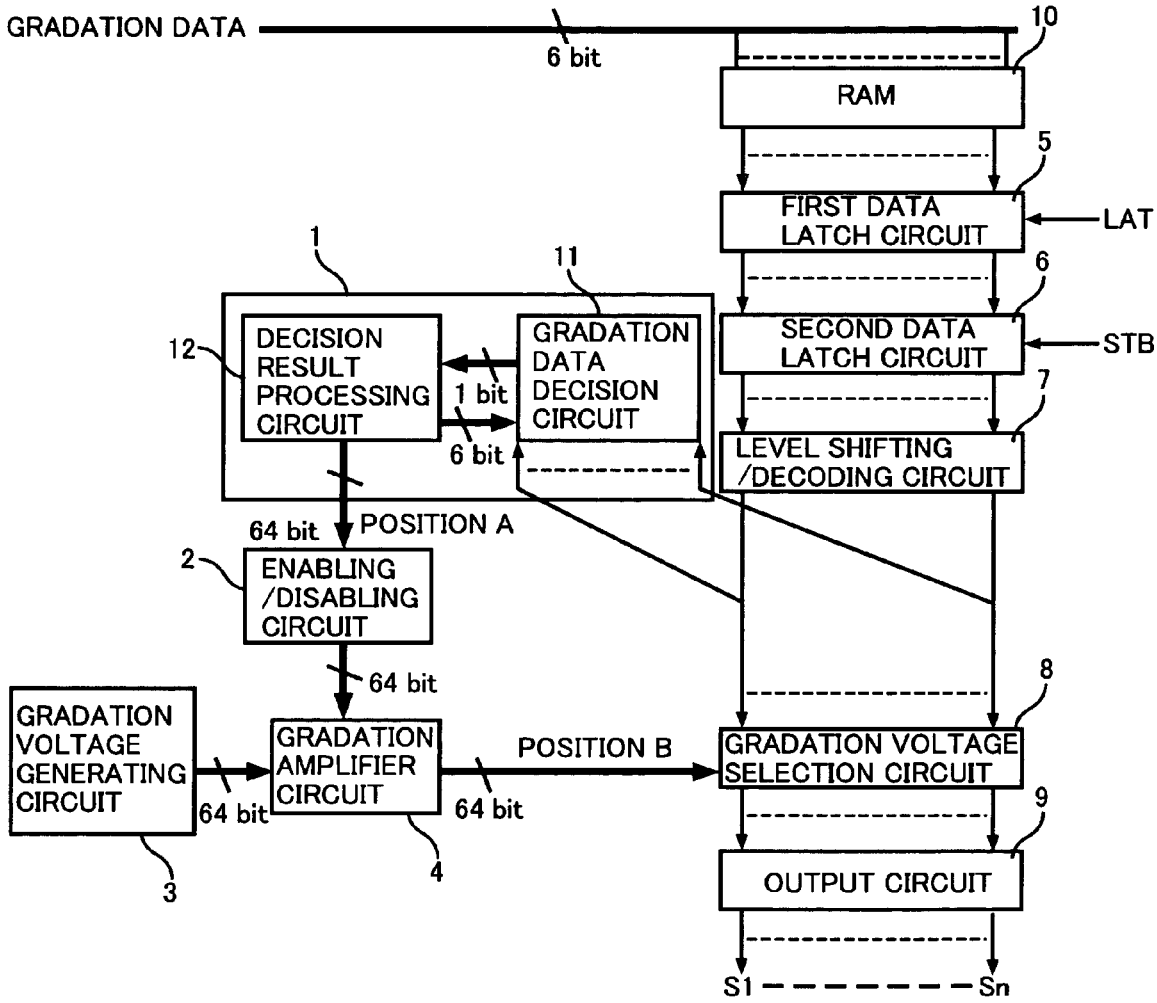
FIG. 9 is a functional block diagram showing the layout of a data line drive circuit according to a fifth embodiment of the present invention.

FIG. 9 shows the layout of a data line drive circuit according to a fifth embodiment of the present invention. In the data line drive circuit according to this fifth embodiment, the gradation data that is input to the decision circuit 1 is obtained from within the level shifting+decoding circuit 7; the rest of the construction is the same as in the case of the first embodiment. Accordingly, identical elements are given the same reference symbols as in FIG. 1 but a detailed description thereof is not repeated. The fifth embodiment is also a "switch drive".

The data flow and principles of operation are the same as in the case of the first embodiment. However, this embodiment differs from the first embodiment in that the decision operation of the decision circuit 1 is commenced after generation of gradation data in the level shifting/decoding circuit 7 after the lapse of a prescribed time after the horizontal signal STB that defines the timing of input to the second data latch circuit 6.

It is clear that, with the data line drive circuit of the fifth embodiment, the same beneficial effects are obtained as in the case of the first embodiment. However, taking into account the overall functions and operation when a plurality of gradations are output, there may be cases where it is not possible for gradation data to be extracted from the second data latch circuit 6 and supplied to the decision circuit 1. In such cases, it is also possible for gradation data to be extracted from the level shifting/decoding circuit 7 as in this fifth embodiment and supplied to the decision circuit 1.

Sixth Embodiment

Figure 10:
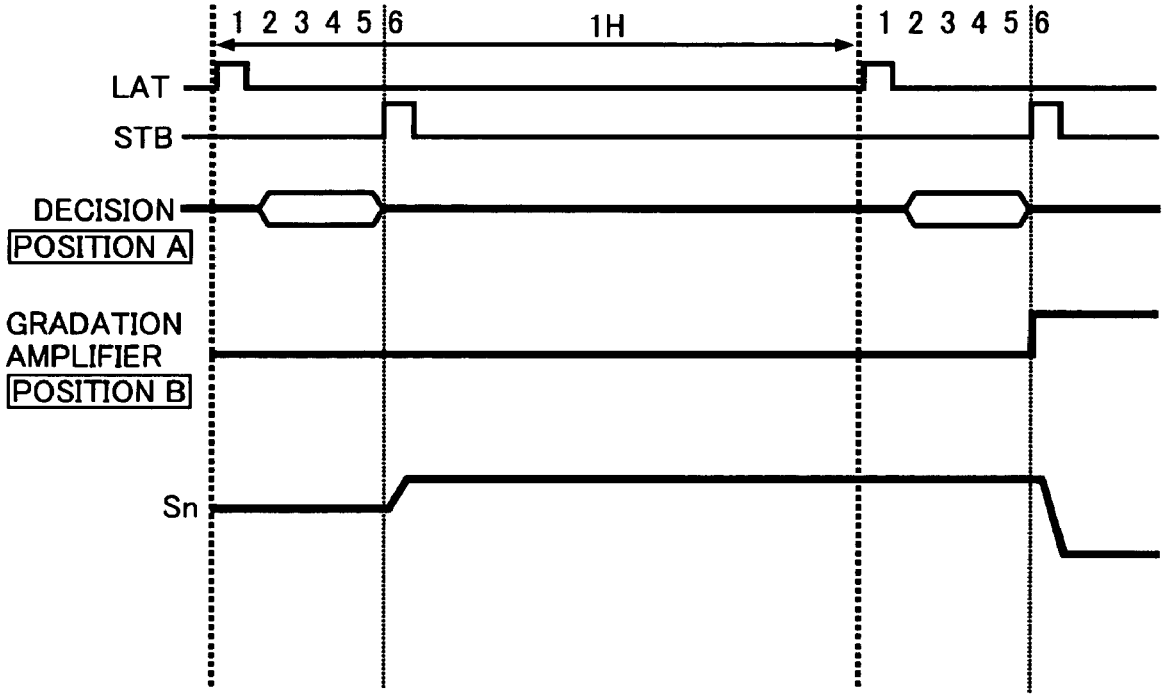
FIG. 10 is a timing chart showing the operation of a data line drive circuit according to a sixth embodiment of the present invention.

FIG. 10 is a timing chart showing the operation of a data line drive circuit according to a sixth embodiment of the present invention.

The construction of the data line drive circuit of this sixth embodiment is the same as that of the first embodiment but differs in the following aspects with regard to the timing chart of FIG. 3.

Specifically, as is clear from the timing chart of FIG. 3, in the first embodiment, the period of the horizontal signal STB becoming H level (i.e. the period in which the horizontal signal STB is applied) and the decision operation overlap. However, the present invention is not restricted to this and it is possible to arrange for these not to overlap. The sixth embodiment achieves this.

In the sixth embodiment, the decision circuit 1 performs the decision operation immediately after input of the data of the latch signal LAT becoming H level (i.e. the timing with which the latch signal LAT is applied). However, application of the horizontal signal STB indicating the timing of gradation voltage output is performed after determination of use/non-use of each gradation after termination of the decision operation. In other words, the timing of application of the horizontal signal STB is delayed from the time corresponding to the sum of the time required for the gradation data input operation by the first data latch circuit 5 and the time required for the decision operation. Application of the analogue gradation voltage to the data electrode is therefore also performed after completion of the decision operation.

Gradation amplifiers 4*a* whose operation is not required will therefore remain completely unoperated, so the advantage is obtained that the beneficial effect of reduction of current consumption is further improved compared to the case of the first embodiment.

Modified Examples

In the above embodiments, the present invention was applied to a liquid-crystal display device, the present invention is not restricted to this. The present invention could be applied to any other type of display device. Also, although, in the above embodiments, examples were described of application of the present invention to a display device incorporating RAM, the present invention could also be applied to display devices that do not incorporate RAM.

It is apparent that the present invention is not limited to the above embodiment, that may be modified and changed without departing from the scope and spirit of the invention.

What is claimed is:

1. A drive circuit for driving a display device in which a plurality of scanning lines and a plurality of data lines are arranged in matrix fashion, said drive circuit comprising:

a first data latch circuit that holds image data corresponding to one line from given image data;

a second data latch circuit that holds image data held in the first data latch circuit;

a decoding circuit that decodes the image data held in the second data latch circuit;

a gradation amplifier circuit comprising a plurality of gradation amplifiers that amplify or buffer, and output, a respective plurality of gradation voltages;

a gradation voltage selection circuit that selects gradation voltages that are necessary for display from the plurality of gradation voltages that are output from the gradation amplifier circuit, and outputs these selected gradation voltages to an output circuit;

a decision circuit that decides on a use/non-use of gradations based on receiving and selectively using image data that are output from the first data latch circuit to said second data latch circuit, the image data that are output from the second data latch circuit, or the image data that are output from the decoding circuit; and an enabling/disabling circuit that selectively disables operation of the gradation amplifiers corresponding to gradations that are decided as not to be used, using decision results output from the decision circuit, wherein the decision circuit comprises:

a gradation data decision circuit comprising a plurality of comparator circuits mutually having the same construction and that are connected in cascade; and a decision result processing circuit comprising a reference counter and a shift register, and wherein the decision result data is obtained in the shift register by repeating, while varying the counter value in a prescribed range, the operations in which corresponding gradation data in respective plurality of comparator circuits is compared with a count value delivered from the reference counter, this comparison result is input to a corresponding OR circuit, the OR circuit takes an OR of the comparison result and the output from OR circuits of the comparator circuits connected in cascade, and outputs an OR obtained over the plurality of comparator circuits to the shift register.

2. The drive circuit for a display device according to claim 1, further comprising a frame memory that holds the given image data corresponding to one frame.

3. The drive circuit for a display device according to claim 1, wherein the respective plurality of comparator circuits decode the corresponding gradation data to data having a number of bits corresponding to a number of gradations, determining one bit, of the data having a number of bits corresponding to the number of gradations, corresponding to the selected gradation and other bits corresponding to the unselected gradations.

4. The drive circuit for a display device according to claim 2, wherein the respective plurality of comparator circuits decode the corresponding gradation data to data having a number of bits corresponding to a number of gradations, determining one bit, of the data having a number of bits corresponding to the number of gradations, corresponding to the selected gradation and other bits corresponding to the unselected gradations.

5. The drive circuit for a display device according to claim 1, wherein the decision circuit decides on the use/non-use of the gradations by using the image data held in the first data latch circuit.

6. The drive circuit for a display device according to claim 1, wherein the decision circuit decides on the use/non-use of the gradations by using the image data held in the second data latch circuit.

7. The drive circuit for a display device according to claim 1, wherein the decision circuit decides on the use/non-use of the gradations by using the image data decoded by the decoding circuit.

8. A drive circuit for driving a display device in which a plurality of scanning lines and a plurality of data lines are arranged in matrix fashion, said drive circuit comprising:

a first data latch circuit that holds image data corresponding to one line from given image data;

a second data latch circuit that holds the image data held in the first data latch circuit;

a decoding circuit that decodes the image data held in the second data latch circuit;

a gradation amplifier circuit comprising a plurality of gradation amplifiers that amplify or buffer, and output a respective plurality of gradation voltages;

a gradation voltage selection circuit that selects gradation voltages that are necessary for display from the plurality of gradation voltages that are output from the gradation amplifier circuit, and outputs these selected gradation voltages;

a plurality of amplifiers that amplify or buffer, and output to an output circuit, the gradation voltages selected by the gradation voltage selection circuit;

a decision circuit that decides on a use/non-use of gradations based on receiving and selectively using image data that are output from the first data latch circuit to said second data latch circuit, the image data that are output front the second data latch circuit, or the image data that are output from the decoding circuit; and an enabling/disabling circuit that selectively disables operation of the gradation amplifiers corresponding to gradations that are identified as not to be used, using the decision results output from the decision circuit, wherein the decision circuit comprises:

a gradation data decision circuit comprising a plurality of comparator circuits mutually having the same construction and that are connected in cascade; and a decision result processing circuit comprising a reference counter and a shift register, and wherein the decision result data is obtained in the shift register by repeating, while varying the counter value in a prescribed range, the operations in which corresponding gradation data in respective plurality of comparator circuits is compared with a count value delivered from the reference counter, this comparison result is input to a corresponding OR circuit, the OR circuit takes an OR of the comparison result and the output from OR circuits of the comparator circuits connected in cascade, and outputs an OR obtained over the plurality of comparator circuits to the shift register.

9. The drive circuit for a display device according to claim 8, further comprising a frame memory that holds the given image data corresponding to one frame.

10. The drive circuit for a display device according to claim 8, wherein the respective plurality of comparator circuits decode the corresponding gradation data to data having a number of bits corresponding to a number of gradations, determining one bit, of the data having a number of bits corresponding to the number of gradations, corresponding to the selected gradation and other bits corresponding to the unselected gradations.

11. The drive circuit for a display device according to claim 9, wherein the respective plurality of comparator circuits decode the corresponding gradation data to data having a number of bits corresponding to a number of gradations, determining one bit, of the data having a number of bits corresponding to the number of gradations, corresponding to the selected gradation and other bits corresponding to the unselected gradations.

12. The drive circuit for a display device according to claim 8, wherein the decision circuit decides on the use/non-use of the gradations by using the image data held in the first data Latch circuit.

13. The drive circuit for a display device according to claim 8, wherein the decision circuit decides on the use/non-use of the gradations by using the image data held in the second data latch circuit.

14. The drive circuit for a display device according to claim 8, wherein the decision circuit decides on the use/non-use of the gradations by using the image data decoded by the decoding circuit.

15. A drive circuit for driving a display device in which a plurality of scanning lines and a plurality of data lines are arranged in matrix fashion and uses Random Access Memory (RAM) to store a frame of data, said drive circuit comprising:

a first data latch circuit that holds image data corresponding to one line from given image data from said RAM;

a second data latch circuit that holds image data held in the first data latch circuit;

a decoding circuit that decodes the image data held in the second data latch circuit;

a gradation amplifier circuit comprising a plurality of gradation amplifiers that amplify or buffer, and output, a respective plurality of gradation voltages;

a gradation voltage selection circuit that selects gradation voltages that are necessary for display from the plurality of gradation voltages that are output from the gradation amplifier circuit, and outputs these selected gradation voltages to an output circuit;

a decision circuit that decides on use/non-use of gradations based on receiving and selectively using the image data that are output from the first data latch circuit to said second data latch circuit, the image data that are output from the second data latch circuit, or image data that are output from the decoding circuit and an enabling/disabling circuit that selectively disables operation of the gradation amplifiers corresponding to gradations that are decided as not to be used, using the decision results output from the decision circuit, wherein the decision circuit comprises:

a decision result processing circuit comprising a reference counter and a shift register, wherein the decision result data is obtained in the shift resister by repeating, while varying the counter value in a prescribed range, operations in which corresponding gradation data in a plurality of comparator circuits is compared with a count value delivered from the reference counter, a comparison result being input to a corresponding OR circuit, and wherein the OR circuit takes an OR of the comparison result and the output from OR circuits of the comparator circuits connected in cascade, and outputs an OR obtained over the plurality of comparator circuits to the shift register.

* * * * *